US010309156B2

(12) United States Patent
Azar et al.

(10) Patent No.: US 10,309,156 B2
(45) Date of Patent: Jun. 4, 2019

(54) CUTTING STRUCTURES FOR FIXED CUTTER DRILL BIT AND OTHER DOWNHOLE CUTTING TOOLS

(71) Applicant: SMITH INTERNATIONAL, INC., Houston, TX (US)

(72) Inventors: Michael G. Azar, The Woodlands, TX (US); Bala Durairajan, Sugar Land, TX (US); Madapusi K. Keshavan, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 57 days.

(21) Appl. No.: 14/206,280

(22) Filed: Mar. 12, 2014

(65) Prior Publication Data

US 2014/0262545 A1 Sep. 18, 2014

Related U.S. Application Data

(60) Provisional application No. 61/782,980, filed on Mar. 14, 2013, provisional application No. 61/951,155, filed on Mar. 11, 2014.

(51) Int. Cl.

| | |
|---|---|
| ***E21B 10/567*** | (2006.01) |
| ***E21B 10/43*** | (2006.01) |
| ***E21B 10/55*** | (2006.01) |

(52) U.S. Cl.

CPC ..... *E21B 10/5673* (2013.01); *E21B 10/43* (2013.01); *E21B 10/55* (2013.01)

(58) Field of Classification Search

USPC ..... 175/430

See application file for complete search history.

(56) References Cited

U.S. PATENT DOCUMENTS

| | | | | |
|---|---|---|---|---|
| 4,104,344 A | | 8/1978 | Pope et al. | |
| 4,288,248 A | | 9/1981 | Bovenkerk et al. | |
| 4,602,691 A | | 7/1986 | Weaver | |
| 4,872,520 A | * | 10/1989 | Nelson | E21B 10/60 175/430 |
| 5,127,923 A | | 7/1992 | Bunting et al. | |
| 5,549,171 A | | 8/1996 | Mensa-Wilmot et al. | |

(Continued)

FOREIGN PATENT DOCUMENTS

| | | |
|---|---|---|
| CN | 2297177 Y | 11/1998 |
| CN | 2732975 Y | 10/2005 |

(Continued)

OTHER PUBLICATIONS

International Search Report and Written Opinion issued in PCT/US2014/025279 dated Jul. 21, 2014, 23 pages.

(Continued)

*Primary Examiner* — Taras P Bemko

(57) ABSTRACT

A cutting tool may include a tool body, blades extending from the tool body, and primary cutting elements and backup cutting elements are on each of blades. The backup cutting elements may be behind and at approximately the same radial distance from the axis of the tool body as a corresponding primary cutting element, where the primary cutting elements include cutting elements having a first non-planar shape and the backup cutting elements include cutting elements having a second, different non-planar shape.

8 Claims, 15 Drawing Sheets

(56) References Cited

U.S. PATENT DOCUMENTS

| | | | |
|---|---|---|---|
| 5,752,573 | A | 5/1998 | Scott et al. |
| 5,871,060 | A | 2/1999 | Jensen et al. |
| 5,881,830 | A | 3/1999 | Cooley |
| 6,003,623 | A | 12/1999 | Miess |
| 6,021,859 | A | 2/2000 | Tibbitts |
| 6,148,937 | A | 11/2000 | Mensa-Wilmot et al. |
| 6,176,333 | B1 | 1/2001 | Doster |
| 6,241,035 | B1 | 6/2001 | Portwood |
| 6,330,924 | B1 | 12/2001 | Hall |
| 6,332,503 | B1 | 12/2001 | Pessier et al. |
| 6,427,792 | B1 | 8/2002 | Roberts et al. |
| 6,499,547 | B2 | 12/2002 | Scott et al. |
| 6,510,910 | B2 | 1/2003 | Eyre et al. |
| 7,234,550 | B2 | 6/2007 | Azar et al. |
| 7,360,608 | B2 | 4/2008 | Brackin et al. |
| 7,455,125 | B2 | 11/2008 | Sinor et al. |
| 7,533,738 | B1 | 5/2009 | Hall et al. |
| 7,690,442 | B2 | 4/2010 | Portwood et al. |
| 7,690,971 | B2 | 4/2010 | Sung |
| 7,726,420 | B2 | 6/2010 | Shen et al. |
| 7,757,785 | B2 | 7/2010 | Zhang et al. |
| 8,087,478 | B2 | 1/2012 | Patel |
| 8,109,346 | B2 | 2/2012 | Mensa-Wilmot |
| 8,127,863 | B2 | 3/2012 | Durairajan et al. |
| 8,172,008 | B2 | 5/2012 | Dykstra et al. |
| 8,567,532 | B2 | 10/2013 | Hall et al. |
| 2005/0269139 | A1 | 12/2005 | Shen |
| 2006/0180356 | A1 | 8/2006 | Durairajan et al. |
| 2007/0062736 | A1 | 3/2007 | Cariveau et al. |
| 2007/0079995 | A1 | 4/2007 | McClain et al. |
| 2007/0215389 | A1* | 9/2007 | Da Silva ..... E21B 10/42 175/331 |
| 2007/0278017 | A1 | 12/2007 | Shen et al. |
| 2008/0035380 | A1 | 2/2008 | Hall et al. |
| 2008/0035387 | A1 | 2/2008 | Hall et al. |
| 2008/0142275 | A1 | 8/2008 | Griffin et al. |
| 2008/0264696 | A1 | 10/2008 | Dourfaye et al. |
| 2010/0059287 | A1 | 3/2010 | Durairajan et al. |
| 2010/0059289 | A1 | 3/2010 | Hall et al. |
| 2010/0065332 | A1 | 3/2010 | Hall et al. |
| 2010/0155149 | A1 | 6/2010 | Keshavan et al. |
| 2010/0219001 | A1* | 9/2010 | Shen ..... E21B 10/5673 175/432 |
| 2010/0263939 | A1 | 10/2010 | Hall et al. |
| 2010/0307829 | A1* | 12/2010 | Patel ..... E21B 10/5673 175/57 |
| 2011/0000714 | A1 | 1/2011 | Durairajan et al. |
| 2011/0100724 | A1* | 5/2011 | Azar ..... E21B 10/43 175/428 |
| 2011/0155472 | A1 | 6/2011 | Lyons et al. |
| 2011/0192651 | A1 | 8/2011 | Lyons et al. |
| 2011/0266070 | A1 | 11/2011 | Scott et al. |
| 2012/0031674 | A1 | 2/2012 | Lyons |
| 2012/0205163 | A1 | 8/2012 | Azar et al. |
| 2012/0234610 | A1 | 9/2012 | Azar et al. |
| 2012/0247834 | A1 | 10/2012 | Buxbaum et al. |
| 2013/0075166 | A1 | 3/2013 | Cox |
| 2013/0112485 | A1 | 5/2013 | Richert et al. |
| 2013/0292185 | A1 | 11/2013 | Knull et al. |

FOREIGN PATENT DOCUMENTS

| | | | |
|---|---|---|---|
| CN | 1734054 | A | 2/2006 |
| CN | 2777175 | Y | 5/2006 |
| CN | 2828298 | Y | 10/2006 |
| CN | 200964797 | Y | 10/2007 |
| CN | 201024900 | Y | 2/2008 |
| CN | 201334873 | Y | 10/2009 |
| CN | 201396071 | Y | 2/2010 |
| CN | 201513124 | U | 6/2010 |
| CN | 201526273 | U | 7/2010 |
| CN | 201588550 | U | 9/2010 |
| CN | 201771431 | U | 3/2011 |
| CN | 201943584 | U | 8/2011 |
| CN | 202176265 | U | 3/2012 |
| GB | 2328233 | A | 2/1999 |
| GB | 2428840 | A | 2/2007 |
| RU | 2315850 | C1 | 1/2008 |
| WO | 2012109517 | A1 | 8/2012 |

OTHER PUBLICATIONS

International Search Report and Written Opinion issued in PCT/US2014/025294 dated Aug. 14, 2014, 22 pages.

"PDC cutter/Sharp-edge PDC cutters/Synthetic polycrystalline diamond", Retrieved from <http://3bdiamond.en.alibaba.com/product/694306890-215141609/PDC_cutter_Sharp_edge_PDC_cutters_Synthetic_polycrystalline_diamond.html>, Accessed Jun. 26, 2014; 4 pages.

"PDC inserts", Hunan Feiray Composite Material Co., Ltd., Retrieved from the Internet: <http://perfect-pdc.en.made-in-china.com/product/woRQOXnJHIVr/China-PDC-Inserts.html>, Accessed Jun. 2, 2014; 3 pages.

Crowe, et al., "A new effective method of maintaining "hole gauge" using synthetic diamond enhanced inserts on downhole drilling tools", SPE 57556—SPE/IADC Middle East Drilling Technology Conference, Abu Dhabi, United Arab Emirates, Nov. 8-10, 1999; 11 pages.

Fan, et al., "Mechanism of the Effect of Interface Structure on the Abrasion Performance of Polycrystalline Diamond Compact", Advanced Materials Research, vols. 230-232, 2011, pp. 669-673; 6 pages.

Keshavan, et al., "Diamond-Enhanced Insert: New Compositions and Shapes for Drilling Soft-to-Hard Formations", SPE 25737—SPE/IADC Drilling Conference, Amsterdam, Netherlands, Feb. 22-25, 1993; 15 pages.

Mensa-Wilmot, et al., "Innovative cutting structure, with staged rop and durability characteristics, extends PDC bit efficiency into chert/pyrite/conglomerate applications", SPE 105320-MS—SPE Middle East Oil and Gas Show and Conference, Kingdom of Bahrain, Mar. 11-14, 2007; 9 pages.

Newkut Industries, "Polycrystalline Diamond (PDC) news", Retrieved from <https://web.archive.org/web/20120702214438/http://www.newkut.com/polycrystaline-diamond-PDC-cutters-news.htm>, Accessed Jun. 26, 2014; 1 page.

Wise, et al., "Geometry and Material Choices Govern Hard-Rock Drilling Performance of PDC Drag Cutters"; Alaska Rocks, The 40th U.S. Symposium on Rock Mechanics (USRMS), Anchorage, AK, Jun. 25-29, 2005; 12 pages.

Zhengzhou Ld Diamond Products Co, , "Spherical PDC cutter/dome PDC cutter", Retrieved from <http://www.weiku.com/products/10442969/Spherical_PDC_cutter_Dome_PDC_cutter.html>, Accessed Jun. 26, 2014; 3 pages.

First Office Action issued in related CN application 201480014746.6 dated May 30, 2016, 18 pages.

Office Action issued in related RU application 2015143598 dated Jun. 27, 2016, 13 pages.

First Office Action issued in related CN application 201480014751.7 dated Jun. 1, 2016, 19 pages.

Third Office Action issued in Chinese Patent Application No. 201480014746.6 dated May 27, 2017, 21 pages.

Decision on Grant issued in Russian Patent Application No. 2015143435 dated Apr. 21, 2017.

Decision on Grant issued in Russian Patent Application No. 2015143598 dated Apr. 21, 2017.

Office Action issued in U.S. Appl. No. 14/206,228 dated Mar. 7, 2017.

Office Action issued in U.S. Appl. No. 14/613,144 dated Dec. 29, 2016.

Office Action issued in related Russian Patent Application No. 2015143435 dated Sep. 9, 2016, 5 pages.

Office Action issued in related Russian Patent Application No. 2015143598 dated Oct. 20, 2016, 4 pages.

International Search Report and Written Opinion issued in related International Patent Application No. PCT/US2015/014561 dated May 29, 2015, 20 pages.

(56) References Cited

OTHER PUBLICATIONS

International Preliminary Report on Patentability issued in related International Patent Application No. PCT/US2014/025279 dated Sep. 24, 2015, 15 pages.
International Preliminary Report on Patentability issued in related International Patent Application No. PCT/US2014/025294 dated Sep. 24, 2015, 14 pages.
International Preliminary Report on Patentability issued in related International Patent Application No. PCT/US2015/014561 dated Sep. 22, 2016, 13 pages.
Second Office Action issued in related Chinese Application 201480014746.6 dated Jan. 16, 2017, 19 pages.
Office Action issued in U.S. Appl. No. 14/206,228 dated Aug. 4, 2017, 20 pages.
Office Action issued in U.S. Appl. No. 14/613,144 dated Aug. 9, 2017, 19 pages.
Decision of Rejection issued in Chinese Patent Application No. 201480014751.7 dated Aug. 31, 2017, 17 pages.
First Office Action and Search Report issued in Chinese Patent Application No. 201580024812.2 dated Feb. 1, 2018, 15 pages.

* cited by examiner

CUTTING STRUCTURES FOR FIXED CUTTER DRILL BIT AND OTHER DOWNHOLE CUTTING TOOLS

CROSS-REFERENCE TO RELATED APPLICATIONS

This application claims priority to and the benefit of related U.S. Provisional Application No. 61/782,980, filed on Mar. 14, 2013, entitled, "CUTTING STRUCTURES FOR FIXED CUTTER DRILL BIT AND OTHER DOWNHOLE CUTTING TOOLS" to inventors Azar et al. and U.S. Provisional Application No. 61/951,155, filed on Mar. 11, 2014, entitled "CUTTING ELEMENTS HAVING NON-PLANAR SURFACES AND DOWNHOLE CUTTING TOOLS USING SUCH CUTTING ELEMENTS" to inventor Chen et al., the entire contents of both of which are fully incorporated herein by reference.

BACKGROUND

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element includes an elongate and generally cylindrical tungsten carbide substrate that is received and secured in a pocked formed in the surface of one of the blades. The cutting elements typically include a hard cutting layer of polycrystalline diamond ("PCD") or other superabrasive materials such as thermally stable diamond or polycrystalline cubic boron nitride. For convenience, as used herein, reference to "PDC bit" or "PDC cutters" refers to a fixed cutter bit or cutting element employing a hard cutting layer of polycrystalline diamond or other superabrasive materials.

Referring to FIGS. 1 and 2, a conventional fixed cutter or drag bit 10 adapted for drilling through formations of rock to form a borehole is shown. The bit 10 generally includes a bit body 12, a shank 13, and a threaded connection or pin 14 at a pin end 16 for connecting the bit 10 to a drill string (not shown) that is employed to rotate the bit in order to drill the borehole. The bit face 20 supports a cutting structure 15 and is formed on the end of the bit 10 that is opposite the pin end 16. The bit 10 further includes a central axis 11 about which the bit 10 rotates in the cutting direction represented by arrow 18.

A cutting structure 15 is provided on the face 20 of the bit 10. The cutting structure 15 includes a plurality of angularly spaced-apart primary blades 31, 32, 33, and secondary blades 34, 35, 36, each of which extends from the bit face 20. The primary blades 31, 32, 33 and the secondary blades 34, 35, 36 extend generally radially along the bit face 20 and then axially along a portion of the periphery of the bit 10. However, the secondary blades 34, 35, 36 extend radially along the bit face 20 from a position that is distal the bit axis 11 toward the periphery of the bit 10. Thus, as used herein, "secondary blade" may be used to refer to a blade that begins at some distance from the bit axis and extends generally radially along the bit face to the periphery of the bit. The primary blades 31, 32, 33 and the secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip 44*a* furthest from the blade tops 42, 52 to which the cutting elements 40 are mounted.

Referring now to FIG. 3, a profile of bit 10 is shown as it would appear with all blades (e.g., primary blades 31, 32, 33 and secondary blades 34, 35, 36) and cutting faces 44 of all cutting elements 40 rotated into a single rotated profile. In rotated profile view, blade tops 42, 52 of all blades 31-36 of the bit 10 form and define a combined or composite blade profile 39 that extends radially from the bit axis 11 to the outer radius 23 of the bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

The conventional composite blade profile 39 (most clearly shown in the right half of bit 10 in FIG. 3) may generally be divided into three regions conventionally labeled cone region 24, shoulder region 25, and gage region 26. The cone region 24 includes the radially innermost region of the bit 10 and the composite blade profile 39 extending generally from the bit axis 11 to the shoulder region 25. As shown in FIG. 3, in most conventional fixed cutter bits, the cone region 24 is generally concave. Adjacent the cone region 24 is the shoulder (or the upturned curve) region 25. In most conventional fixed cutter bits, the shoulder region 25 is generally convex. Moving radially outward, adjacent the shoulder region 25 is the gage region 26 which extends parallel to the bit axis 11 at the outer radial periphery of the composite blade profile 39. Thus, the composite blade profile 39 of the conventional bit 10 includes one concave region, cone region 24, and one convex region, shoulder region 25.

The axially lowermost point of the convex shoulder region 25 and the composite blade profile 39 defines a blade profile nose 27. At the blade profile nose 27, the slope of a tangent line 27*a* to the convex shoulder region 25 and the composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes only one convex shoulder region (e.g., convex shoulder region 25), and only one blade profile nose (e.g., nose 27). As shown in FIGS. 1-3, the cutting elements 40 are arranged in rows along the blades 31-36 and are positioned along the bit face 20 in the regions previously described as cone region 24, shoulder region 25 and gage region 26 of the composite blade profile 39. In particular, the cutting elements 40 are mounted on the blades 31-36 in predetermined radially-spaced positions relative to the central axis 11 of the bit 10.

Without regard to the type of bit, the cost of drilling a borehole is proportional to the length of time it takes to drill the borehole to the desired depth and location. The drilling time, in turn, is greatly affected by the number of times the drill bit is changed before reaching the targeted formation. This is the case because each time the bit is changed, the entire drill string, which may be miles long, must be retrieved from the borehole section by section. Once the drill string has been retrieved and the new bit installed, the bit must be lowered to the bottom of the borehole on the drill string, which again, must be constructed section by section. This process, known as a "trip" of the drill string, often requires considerable time, effort, and expense. Accordingly, it is desirable to employ drill bits that will drill faster and longer and that are usable over a wider range of differing formation hardnesses.

The length of time that a drill bit may be employed before it is changed depends upon its rate of penetration ("ROP"), as well as its durability or ability to maintain a high or acceptable ROP. Additionally, a desirable characteristic of the bit is that it be "stable" and resist undesirable vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes premature wearing or destruction of the cutting elements and a loss of ROP. Thus, preventing or reducing undesirable bit vibration and maintaining stability of PDC bits has long been a desirable goal, but one that has not always been achieved. Undesirable bit vibration typically may occur in any type of formation, but is most detrimental in harder formations.

In recent years, the PDC bit has become an industry standard for cutting formations of soft and medium hardnesses. However, as PDC bits are being developed for use in harder formations, bit stability is becoming an increasing challenge. As previously described, excessive undesirable bit vibration during drilling tends to dull the bit and/or may damage the bit to an extent that a premature trip of the drill string becomes necessary or desired.

There have been a number of alternative designs proposed for PDC cutting structures that were meant to provide a PDC bit capable of drilling through a variety of formation hardnesses at effective ROPs and with acceptable bit life or durability. Unfortunately, many of the bit designs aimed at minimizing vibration require that drilling be conducted with an increased weight-on-bit ("WOB") as compared to bits of earlier designs. For example, some bits have been designed with cutters mounted at less aggressive back rake angles such that they require increased WOB in order to penetrate the formation material to the desired extent. Drilling with an increased or heavy WOB is generally avoided if possible. Increasing the WOB is accomplished by adding additional heavy drill collars to the drill string. This additional weight increases the stress and strain on some or all drill string components, causes stabilizers to wear more and to work less efficiently, and increases the hydraulic drop in the drill string, requiring the use of higher capacity (and typically higher cost) pumps for circulating the drilling fluid. Compounding the problem still further, the increased WOB causes the bit to wear and become dull more quickly than would otherwise occur. In order to postpone tripping the drill string, it is common practice to add further WOB and to continue drilling with the partially worn and dull bit. The relationship between bit wear and WOB is not linear, but is an exponential one, such that upon exceeding a particular WOB for a given bit, a very small increase in WOB will cause a tremendous increase in bit wear. Thus, adding more WOB so as to drill with a partially worn bit further escalates the wear on the bit and other drill string components.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some embodiments a cutting tool includes a tool body and a plurality of blades extending from the tool body. A plurality of primary cutting elements and a plurality of backup cutting elements are on each of the plurality of blades, the backup cutting elements being behind and at approximately the same radial distance from the axis of the tool body as a corresponding primary cutting element. The plurality of primary cutting elements include cutting elements having a first non-planar shape and the plurality of backup cutting elements include cutting elements having a second, different non-planar shape.

In some embodiments, a cutting tool includes a tool body and a plurality of blades extending from the tool body. A plurality of primary cutting elements and a plurality of backup cutting elements are on each of the plurality of blades, the backup cutting elements being behind and at approximately the same radial distance from the axis of the tool body as a corresponding primary cutting element. The plurality of primary cutting elements include ridge cutting elements and the plurality of backup cutting elements include pointed cutting elements.

In some embodiments, a cutting tool includes a tool body and a plurality of blades extending from the tool body. A plurality of non-planar cutting elements on each of the plurality of blades, the plurality of non-planar cutting elements forming at least a portion of a cutting profile, in a rotated view of the plurality of non-planar cutting elements into a single plane. The cutting profile includes a cone region, a nose region, a shoulder region, and a gage region, and the plurality of non-planar cutting elements include a ridge cutting element in at least one of the cone region, nose region, shoulder region, and gage region, and a pointed cutting element in at least one other region.

Other aspects and advantages of the claimed subject matter will be apparent from the following description and the appended claims.

DETAILED DESCRIPTION

In aspects of the present disclosure, embodiments relate to fixed cutting drill bits or other downhole cutting tools containing cutting elements with non-planar cutting surfaces. In particular, embodiments disclosed herein relate to drill bits containing two or more non-planar cutting elements, the at least two cutting elements having different geometric or dimensional profiles. Other embodiments disclosed herein relate to fixed cutter drill bits containing such cutting elements, including the placement of such cutting elements on a bit and variations on the cutting elements that may be used to optimize or improve drilling.

Figure 3:
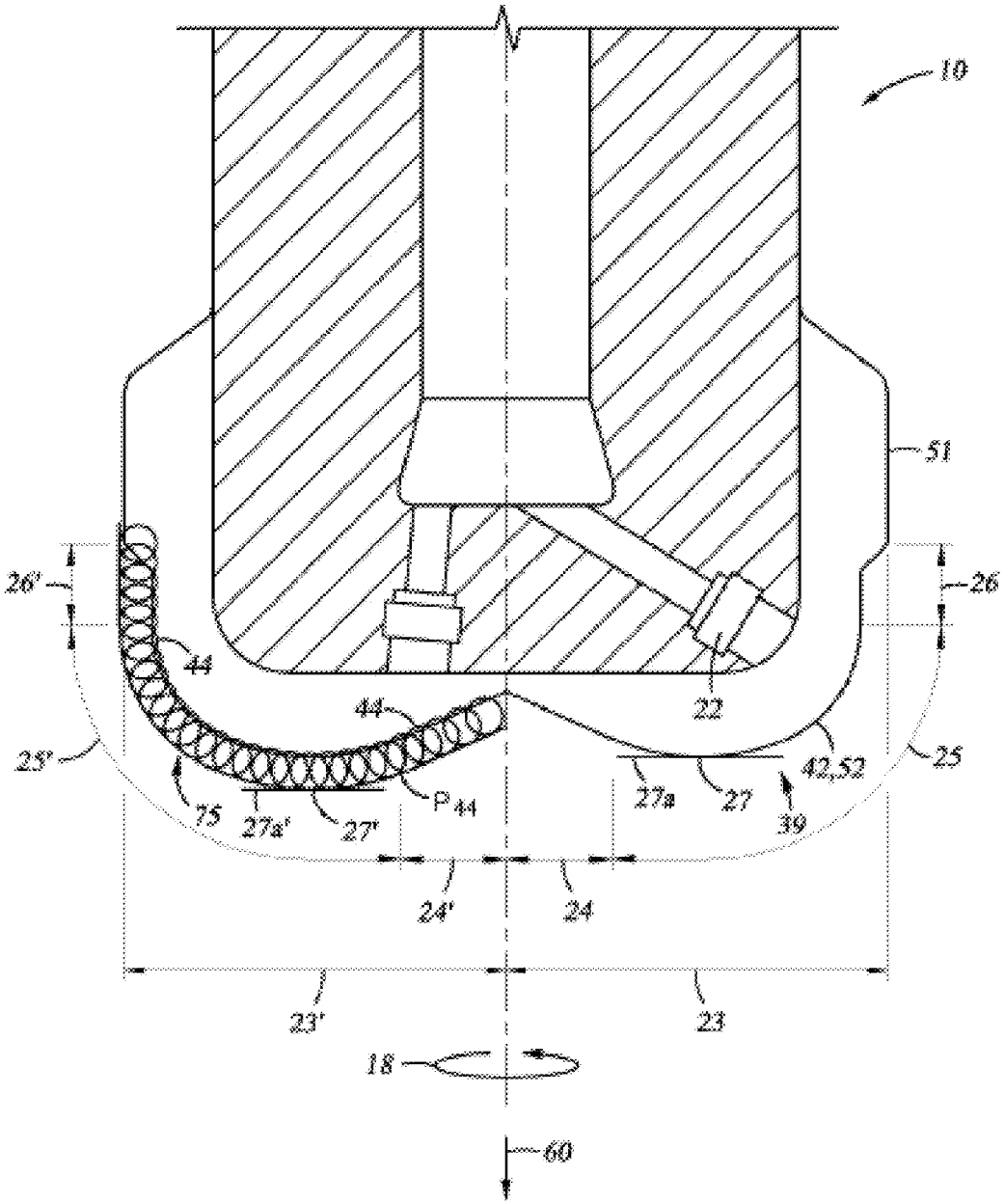
Fig. 3 (PRIOR ART)
FIG. 3 shows a cross-sectional view of a conventional drill bit.
Figure 4:
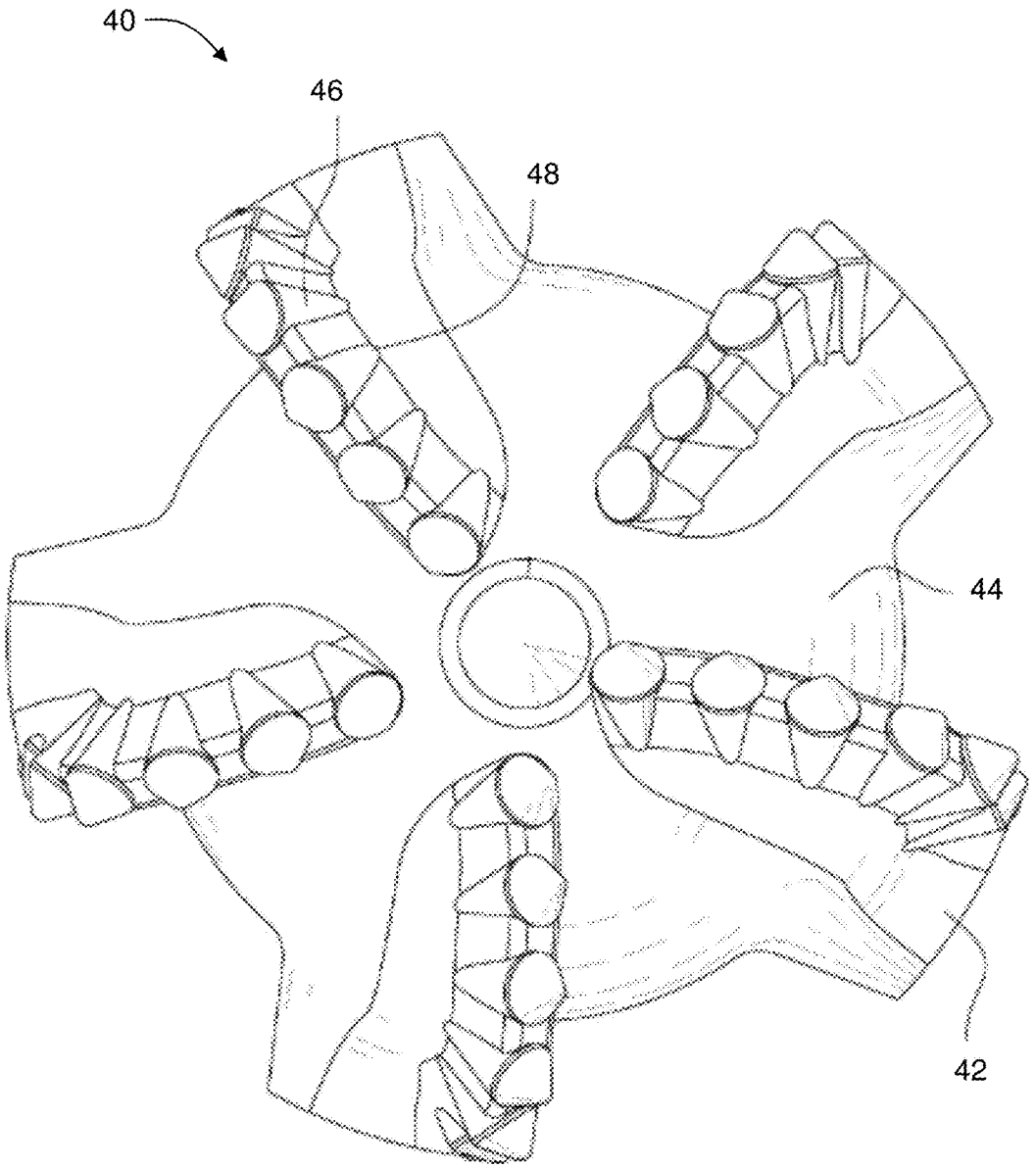
FIG. 4 shows a top view of a drill bit according to one embodiment.
Figure 5:
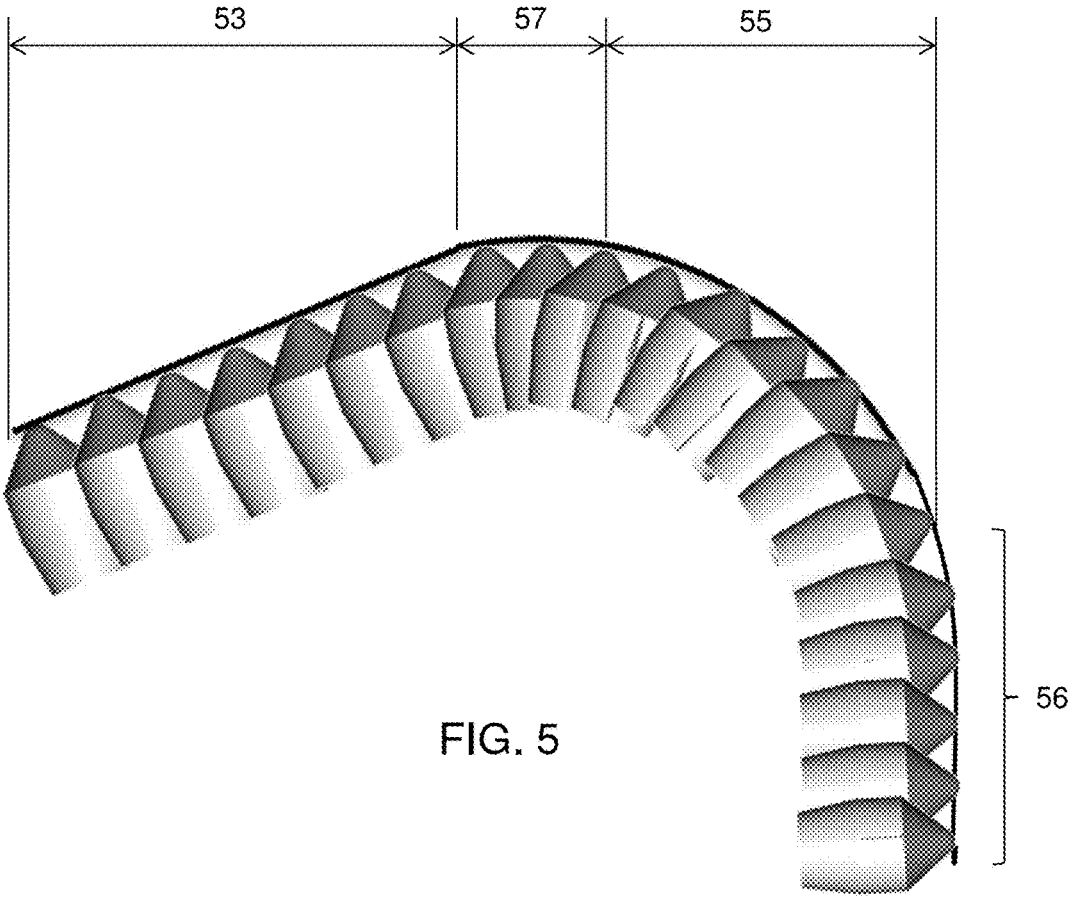
FIG. 5 shows a cutting profile according to one embodiment.

In accordance with one or more embodiments of the present disclosure, different non-planar cutting elements may be used, and the geometry selected may be based on the location of the particular non-planar cutting element along the cutting profile, as defined, for example, with reference to FIG. 3. Referring now to FIG. 4, the top view of an embodiment of a drill bit is shown. As shown in FIG. 4, a drill bit 40 may include a plurality of blades 42 extending radially from a bit body 44. Non-planar cutting elements 46 are each within cutter pockets 48 on the plurality of blades 42. While only non-planar cutting elements are illustrated in FIG. 4, is it also within the scope of the present disclosure that one or more blades may include one or more planar or substantially planar cutting elements thereon. Referring now to FIG. 5, a cutting profile (where all cutting elements on a bit are shown rotated into a single plane) is shown. Similar to the cutting profile defined above in FIG. 3, the cutting profile 50 shown in FIG. 5 includes a cone region 53, a nose region 57, a shoulder region, 55, and gage region 56; however, in the embodiment shown in FIG. 5, the cutting profile is formed from non-planar cutting elements. Further, while the non-planar cutting elements shown in FIG. 5 are conical cutting elements, the present disclosure is not so limited. Rather, one or more, or all of the cutting elements forming a cutting profile of the present disclosure may include non-planar cutting elements other than conical cutting elements. For example, referring now to FIGS. 6-8, 15, and 16, illustrations of various non-planar cutting elements that may be used in embodiments of the present disclosure are shown.

Figure 1:
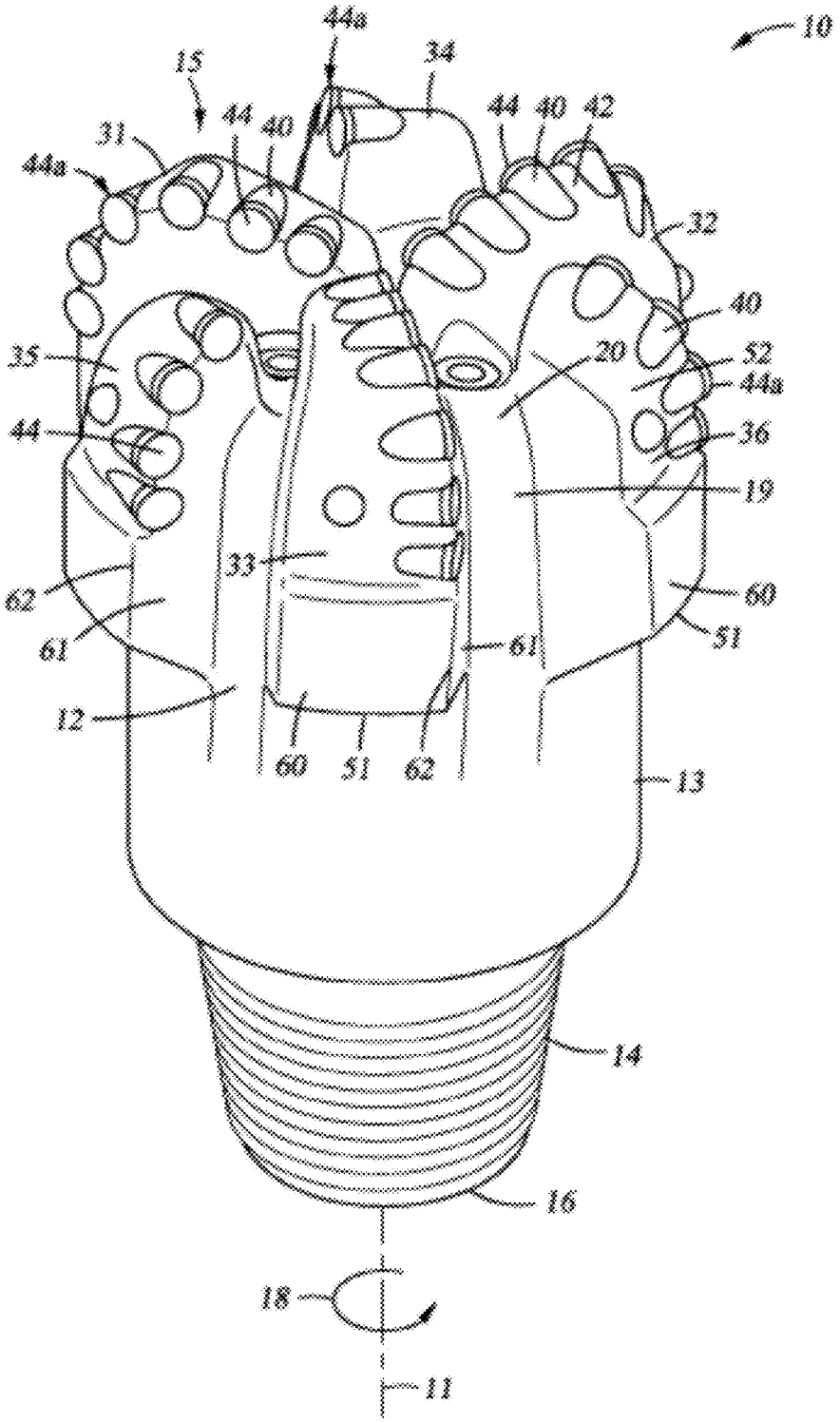
Fig. 1 (PRIOR ART)
FIG. 1 shows a conventional drill bit.
Figure 2:
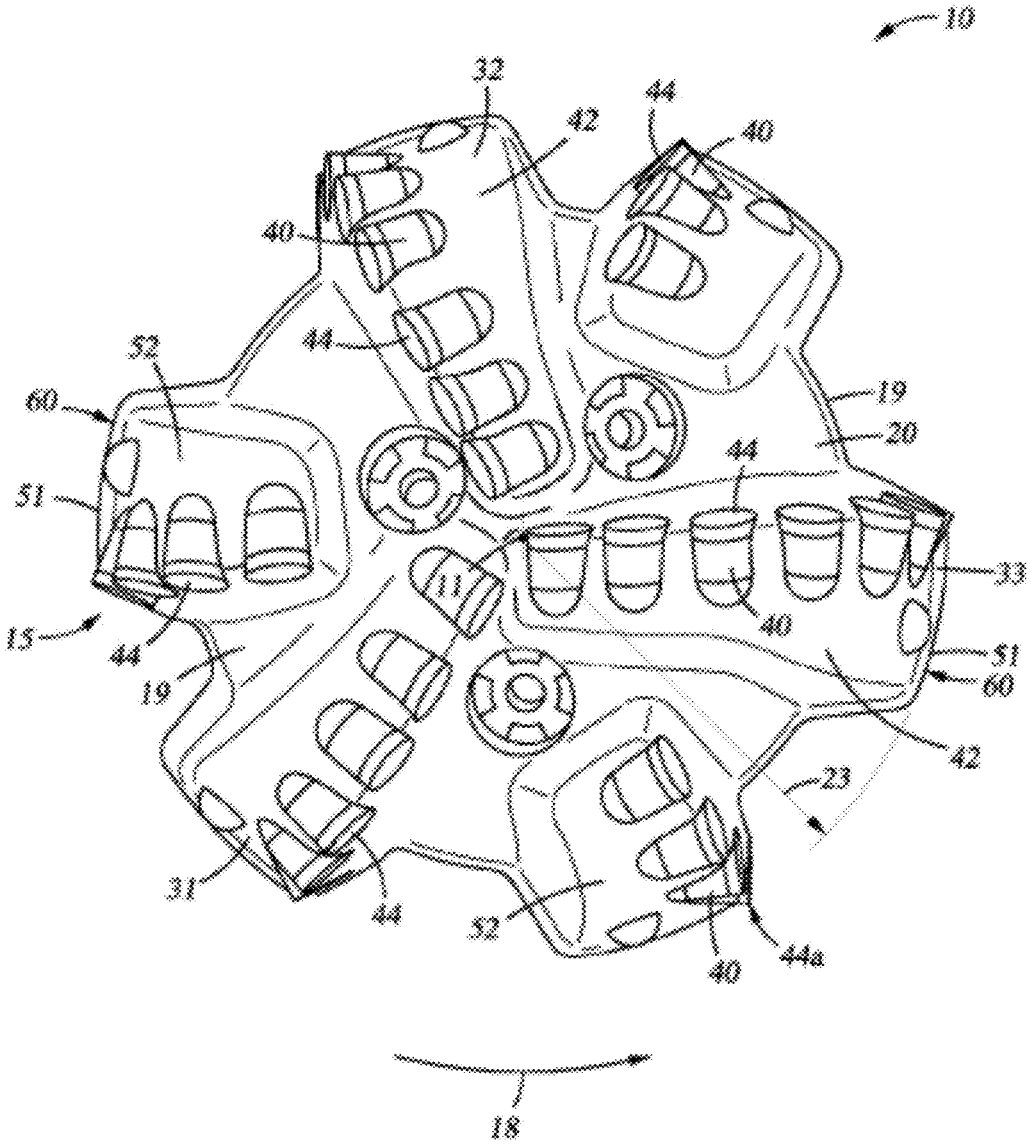
Fig. 2 (PRIOR ART)
FIG. 2 shows a top view of a conventional drill bit.
Figure 6:
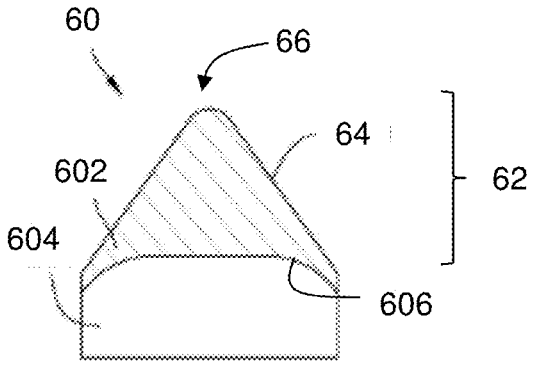
FIG. 6 shows a cross-sectional view of a conical cutting element.
Figure 7:
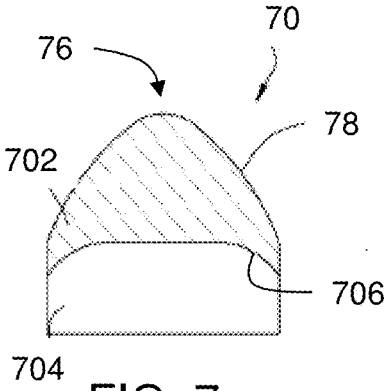
FIG. 7 shows a cross-sectional view of a pointed cutting element having a convex side surface.
Figure 8:
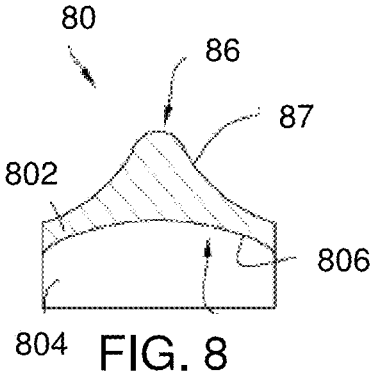
FIG. 8 shows a cross-sectional view of a pointed cutting element having a concave side surface.
Figure 15:
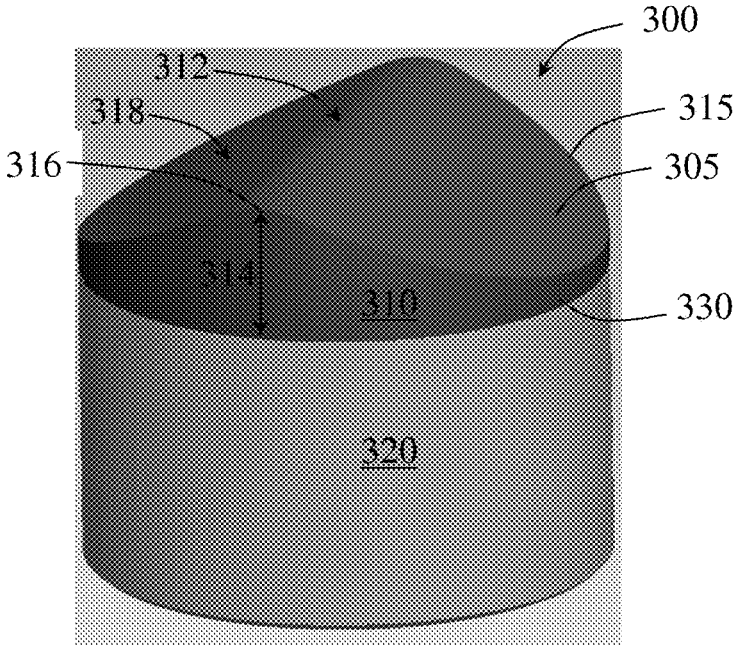
FIG. 15 shows a perspective view of a cutting element having a parabolic cylinder shaped surface.

For ease in distinguishing between the multiple types of cutting elements, the term "cutting elements" will generically refer to any type of cutting element, while "cutter" will refer those cutting elements with a planar cutting face, as described above in reference to FIGS. 1 and 2, and "non-planar cutting element" will refer to those cutting elements having a non-planar surface such as a generally pointed cutting end ("pointed cutting element") or a generally conical cutting element having a crest or ridge cutting region ("ridge cutting element"), e.g., having a cutting end terminating in an apex, which may include cutting elements having a conical cutting end (shown in FIG. 6), a bullet cutting element (shown in FIG. 7), or a generally conical cutting element having a ridge (e.g., a crest or apex) extending across the diameter of the cutting element (shown in FIG. 15), for example. As used herein, the term "conical cutting elements" refers to cutting elements having a generally conical cutting end 62 (including either right cones or oblique cones), i.e., a conical side wall 64 that terminates in a rounded apex 66, as shown in FIG. 6. Unlike geometric cones that terminate at a sharp point apex, the conical cutting elements of the present disclosure possess an apex having curvature between the side surfaces and the apex. Further, in one or more embodiments, a bullet cutting element 70 may be used. The term "bullet cutting element" refers to a cutting element having, instead of a generally conical side surface, a generally convex side surface 78 terminated in a rounded apex 76. In one or more embodiments, the apex 76 has a substantially smaller radius of curvature than the convex side surface 78. Both conical cutting elements and bullet cutting elements are "pointed cutting elements," having a pointed end that may be rounded. However, it is also intended that the non-planar cutting elements of the present disclosure may also include other shapes, including, for example, a pointed cutting element may have a concave side surface terminating in a rounded apex, as shown in FIG. 8. The term "ridge cutting element" refers to a cutting element that is generally cylindrical having a cutting crest (e.g., a ridge or apex) extending a height above the substrate and at least one recessed region extending laterally away from the crest. An embodiment of a ridge cutting element is depicted in FIG. 15, where the cutting element top surface has a parabolic cylinder shape. Variations of the ridge cutting element may also be used, and for example, while the recessed region(s) may be shown as being substantially planar, the recessed region(s) may also be convex or concave. While the crest is shown as extending substantially linearly along its length, it may also be convex or concave and may include one or more peaks and/or valleys, including one or more recessed or convex regions (e.g., depressions in the ridge). In some embodiments, the ridge cutting element may have a top surface that has a reduced height between the two cutting edge portions, thereby forming a substantially saddle shape or hyperbolic paraboloid (as shown in FIG. 17).

In more detail, embodiments of ridge cutting elements may include a cutting element 300 having a non-planar top surface 305 as is shown in FIG. 15. Particularly, the cutting element 300 has an ultrahard layer 310 disposed on a substrate 320 at an interface 330, where the non-planar top surface 305 geometry is formed on the ultrahard layer 310. The ultrahard layer 310 has a peripheral edge 315 surrounding (and defining the bounds of) the top surface 305. The top surface 305 has a cutting crest 312 extending a height 314 above the substrate 320 (at the cutting element circumference), and at least one recessed region extending laterally away from crest 312. As used herein, the crest refers to a portion of the non-planar cutting element that includes the peak(s) or greatest height(s) of the cutting element, which extends in a generally linear fashion or along a diameter of the cutting element. The presence of the crest 312 results in an undulating peripheral edge 315 having peaks and valleys. The portion of the peripheral edge 315 which is proximate the crest 312 forms a cutting edge portion 316. As shown, the cutting crest 312 may also extend across the diameter of the ultrahard layer, such that two cutting edge portions 316 are formed at opposite sides of the ultrahard layer. The top surface 305 further includes at least one recessed region 318 continuously decreasing in height in a direction away from the cutting crest 312 to another portion of the peripheral edge 315 that is the valley of the undulating peripheral edge 315. The cutting crest 312 and recessed regions 318 in the embodiment shown forms a top surface 305 having an parabolic cylinder shape, where the cutting crest 312 is shaped like a parabola that extends across the diameter of the ultrahard layer 310 and/or substrate 320. While not specifically illustrated, it is specifically intended that at least a portion of the peripheral edge (for example, the cutting edge portion and extending around the portion of the edge that will come into contact with the formation for an expected depth of cut) may be beveled or chamfered. In other embodiments, the entire peripheral edge may be beveled.

Figure 16:
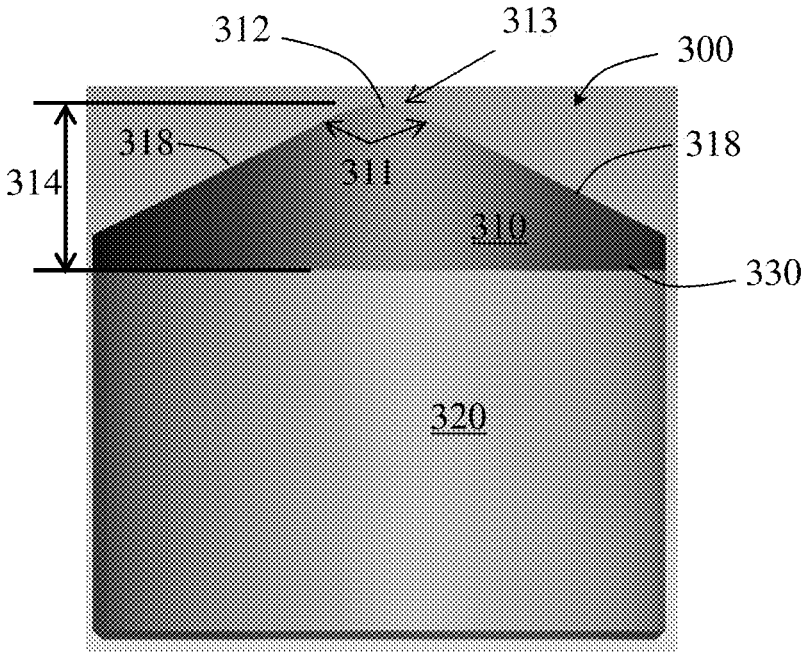
FIG. 16 shows a side view of the cutting element of FIG. 15.

In one or more other embodiments, the cutting crest 312 may extend less than the diameter of the substrate 320 or even greater than the diameter of the substrate 320. For example, the ultrahard layer 310 may form a tapered sidewall at least proximate the cutting edge portion, for example, forming an angle with a line parallel to the axis of the cutting element that may range from −5 degrees (forming a larger diameter than the substrate 320) to 20 degrees (forming a smaller diameter than the substrate 320). Depending on the size of the cutting element, the height 314 of the cutting crest 312 may range, for example, from about 0.1 inch (2.54 mm) to 0.3 inch (7.62 mm). Further, unless otherwise specified, heights of the ultrahard layer (or cutting crests) are relative to the lowest point of the interface of the ultrahard layer and substrate. FIG. 16 shows a side view of the cutting element 300. As shown, the cutting crest 312 has a convex cross-sectional shape (viewed along a plane perpendicular to cutting crest length across the diameter of the ultrahard layer), where the uppermost point of the crest has a radius of curvature 313 that transitions to opposite side surfaces at an angle 311. According to embodiments of the present disclosure, a cutting element top surface may have a cutting crest with a radius of curvature ranging from 0.02 inches (0.51 mm) to 0.300 inches (7.62 mm), or in another embodiment, from 0.06 inches (1.52 mm) to 0.18 inches (4.57 mm). Further, while the illustrated embodiment shows a cutting crest 312 having a curvature at its upper peak, it is also within the scope of the present disclosure that the cutting crest 312 may have a plateau or substantially planar face along at least a portion of the diameter, axially above the recessed regions 318 laterally spaced from the cutting crest 312. Thus, in such an embodiment, the cutting crest may have a substantially infinite radius of curvature. In such embodiments, the plateau may have a radiused transition into the sidewalls that extend to form recessed regions 318. Further, in some embodiments, along a cross-section of the cutting crest 312 extending laterally into depressed regions 318, cutting crest 312 may have an angle 311 formed between the sidewalls extending to recessed regions 318 that may range from 110 degrees to 160 degrees. Further, depending on the type of upper surface geometry, it is also intended that other crest angles, including down to 90 degrees may also be used.

Figure 17:
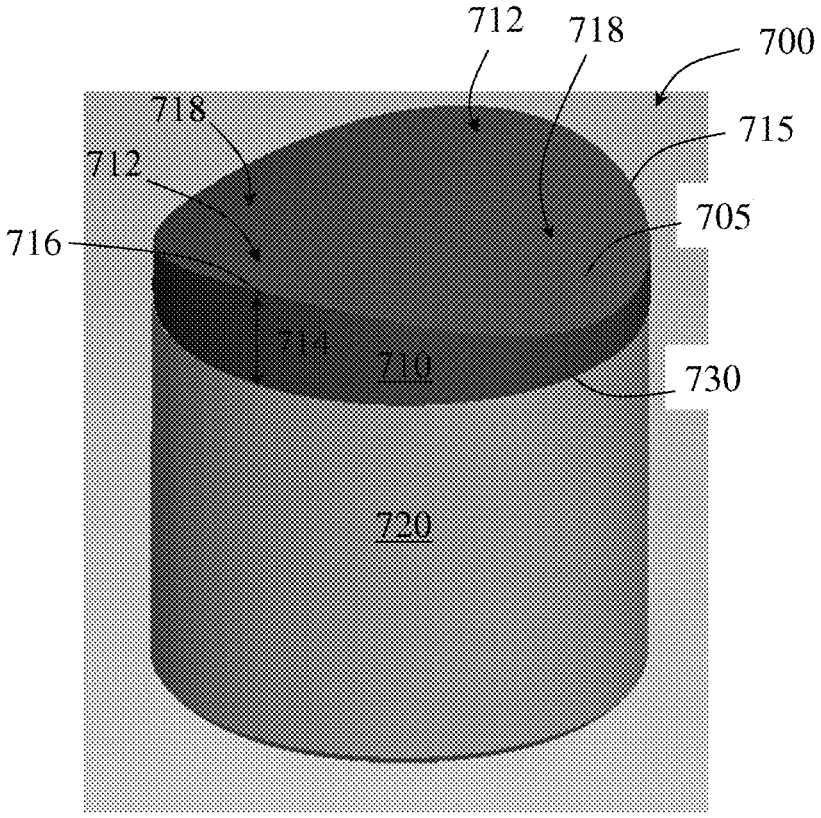
FIG. 17 shows a perspective view of a cutting element having a hyperbolic paraboloid shaped surface.

FIG. 17 shows another example of a cutting element 700 having a non-planar top surface 705. The cutting element 700 has an ultrahard layer 710 disposed on a substrate 720 at an interface 730, where the non-planar top surface 705 is formed on the ultrahard layer 710. The ultrahard layer 710 has a peripheral edge 715 surrounding the top surface 705. The top surface 705 has a non-uniform cutting crest 712. That is, the crest 712 has a non-linear profile (in the y-z plane or crest profile view) such that the crest 712 extends a variable height 714 along its length above the substrate 720/ultrahard layer 710 interface (at the circumference of the cutting element 700). Cutting crest 712 intersects a portion of the peripheral edge 715 to form a cutting edge portion 716. At least one recessed region 718 continuously decreases in height in a direction away from the cutting edge portion 716 to another portion of the peripheral edge 715. Further, as mentioned crest 712 has a variable height that is at its greatest at the intersection with peripheral edge 715 and at its lowest proximate a central axis of the cutting element (i.e., top surface 705 has a reduced height between the two cutting edge portions, thereby forming a substantially saddle shape or hyperbolic paraboloid). As shown, the total height differential of the top surface (between crest and recessed region) is equal to a depth 717. According to some embodiments, a saddle shaped top surface of a cutting element may have a height differential 717 ranging between 0.04 in (1.02 mm) and 0.2 in (5.08 mm) depending on the overall size of the cutting element. For example, the height differential 717 relative to the cutting element diameter may range from 0.1 to 0.5, or from 0.15 to 0.4 in other embodiments. Additionally, in one or more embodiments, the height of the diamond at the peripheral edge adjacent recessed region 718 (i.e., at the side of the cutting element having the lowest diamond height) may be at least 0.04 inches (1.02 mm).

In each of such embodiments (both pointed cutting elements and/or ridge cutting elements), the non-planar cutting elements may have a smooth transition between the side surface and the rounded apex or crest (i.e., the side surface or side wall tangentially joins the curvature of the apex or crest), but in some embodiments, a non-smooth transition may be present (i.e., the tangent of the side surface intersects the tangent of the apex or crest at a non-180 degree angle, such as for example ranging from about 120 to less than 180 degrees). Further, in one or more embodiments, the non-planar cutting elements may include any shape having any cutting end extending above a grip or base region, where the cutting end extends a height that is at least 0.25 times the diameter of the cutting element, or at least 0.3, 0.4, 0.5 or 0.6 times the diameter in one or more other embodiments.

According to embodiments of the present disclosure, cutting elements having an ultrahard layer with a non-planar top surface, such as described above, may have a non-planar interface formed between the ultrahard layer and substrate. For example, according to embodiments of the present disclosure, a ridge cutting element may include a substrate, an upper surface of the substrate including a crest extending along at least a majority of a diameter of the substrate, the upper surface transitioning from the crest into a depressed region, and an ultrahard layer disposed on the substrate upper surface, thereby forming a non-planar interface therebetween. The top surface of the ultrahard layer may have at least one cutting crest extending from a cutting edge portion of the peripheral edge of the top surface radially inward towards a central axis, the peripheral edge decreasing in height in a direction away from the at least one cutting crest and cutting edge portion to another portion of the peripheral edge. The cutting crest and recessed region(s) of the ultrahard layer may correspond to a crest and recessed region(s) of the substrate. However, any planar or non-planar interface may be used with any non-planar interface.

In some embodiments, a ridge cutting element may have a substrate with a side surface, a crest, and at least one depressed region, where the height of the substrate at the crest is greater than the height of the substrate along the at least one depressed region. The crest and the at least one depressed region may define a substrate interface surface, or upper surface, having a substantially hyperbolic paraboloid shape or parabolic cylinder shape. The cutting element may further have an ultrahard layer disposed on the substrate interface surface, thereby forming a non-planar interface, where the ultrahard layer has a peripheral edge surrounding a top surface, the top surface having at least one cutting crest extending a height above the substrate portion along a portion of the peripheral edge to form a first cutting edge portion and at least one recessed region that has a continuously decreasing height from the height of the cutting crest, the height decreasing in a direction away from the cutting crest to another portion of the peripheral edge.

Various embodiments of the present disclosure may use cutting elements of different shapes (such as those shown in FIGS. 6-8, 15, and 16) along the cutting profile. For example, in one embodiment, the cone region may include one or more pointed cutting elements, while the nose, shoulder, and gage region may include one or more non-planar cutting elements that are not pointed cutting elements, such as a ridge cutting element. In particular embodiments, the cone region may include one or more (or all) conical cutting elements, bullet cutting elements, and/or concave cutting elements and the nose, shoulder, and gage regions may include one or more (or all) parabolic cylinder cutting elements and/or cylindrical hyperbolic paraboloid cutting elements.

In another embodiment, the cone and nose regions may include one or more pointed cutting elements, while the shoulder and gage region may include one or more non-planar cutting elements that are not pointed cutting elements, such as a ridge cutting element. In particular embodiments, the cone and nose regions may include one or more (or all) conical cutting elements, bullet cutting elements, and/or concave cutting elements and the shoulder and gage regions may include one or more (or all) parabolic cylinder cutting elements and/or cylindrical hyperbolic paraboloid cutting elements.

In another embodiment, the cone, nose, and shoulder regions may include one or more pointed cutting elements, while the gage region may include one or more non-planar cutting elements that are not pointed cutting elements, such as a ridge cutting element. In particular embodiments, the cone, nose, and shoulder regions may include one or more (or all) conical cutting elements, bullet cutting elements, and/or concave cutting elements, and the gage region may include one or more (or all) parabolic cylinder cutting elements and/or cylindrical hyperbolic paraboloid cutting elements.

In one embodiment, the cone region may include one or more ridge cutting elements, while the nose, shoulder, and gage region may include one or more non-planar cutting elements that are not ridge cutting elements, such as pointed cutting elements. In particular embodiments, the cone region may include one or more (or all) parabolic cylinder cutting elements and/or cylindrical hyperbolic paraboloid cutting elements and the nose, shoulder, and gage regions may include one or more (or all) conical cutting elements, bullet cutting elements, and/or concave cutting elements.

In another embodiment, the cone and nose regions may include one or more ridge cutting elements, while the shoulder and gage region may include one or more non-planar cutting elements that are not ridge cutting elements, such as pointed cutting elements. In particular embodiments, the cone and nose regions may include one or more (or all) parabolic cylinder cutting elements and/or cylindrical hyperbolic paraboloid cutting elements and the shoulder and gage regions may include one or more (or all) conical cutting elements, bullet cutting elements, and/or concave cutting elements.

In another embodiment, the cone, nose, and shoulder regions may include one or more ridge cutting elements, while the gage region may include one or more non-planar cutting elements that are not ridge cutting elements, such as pointed cutting elements. In particular embodiments, the cone, nose, and shoulder regions may include one or more (or all) parabolic cylinder cutting elements and/or cylindrical hyperbolic paraboloid cutting elements and the gage region may include one or more (or all) conical cutting elements, bullet cutting elements, and/or concave cutting elements.

Further, in another embodiment, the cone and shoulder region may have the same selected shape, with a different shape in the nose region. For example, in one embodiment, the cone and shoulder regions may include one or more ridge cutting elements, while the nose region may include one or more non-planar cutting elements that are not a ridge cutting element, such as a pointed cutting element. In particular embodiments, the cone and shoulder region may include one or more (or all) parabolic cylinder cutting elements and/or cylindrical hyperbolic paraboloid cutting elements and the nose region may include one or more (or all) conical cutting elements, bullet cutting elements, and/or concave cutting elements. It is also within the scope of the present disclosure that the gage region may also have one or more (or all) ridge cutting elements.

In another embodiment, the cone and shoulder regions may include one or more pointed cutting elements, while the nose region may include one or more non-planar cutting elements that are not pointed cutting elements, such as a ridge cutting element. In particular embodiments, the cone and shoulder region may include one or more (or all) conical cutting elements, bullet cutting elements, and/or concave cutting elements and the nose region may include one or more (or all) parabolic cylinder cutting elements and/or cylindrical hyperbolic paraboloid cutting elements. It is also within the scope of the present disclosure that the gage region may also have one or more (or all) pointed cutting elements, one or more (or all) ridge cutting elements, or one or more (or all) planar cutting elements.

One or more of the cutting elements in the first row may include a cutting element having a non-planar top surface, such as described above. The cutting elements in the first row may have any shape, and could be, e.g., any of those shapes shown in FIGS. 6-8 and 15-17. The bit may also have a second row of cutting elements disposed along a top face of the at least one blade and rearward from the first row. One or more of the cutting elements in the second row may include a cutting element having a non-planar top surface, such as described above. The cutting elements in the second row may have any shape, and could be, e.g., any of those shapes shown in FIGS. 6-8 and 15-17. One or more of the cutting elements in the second row may have a non-planar top surface shape that is different than that of the first row. For example, in one embodiment, a cutting element in the first row may be that shown in FIG. 15 (e.g., a ridge cutting element), and a cutting element in the second row may be that shown in FIG. 6 (e.g., a pointed cutting element).

Figure 18:
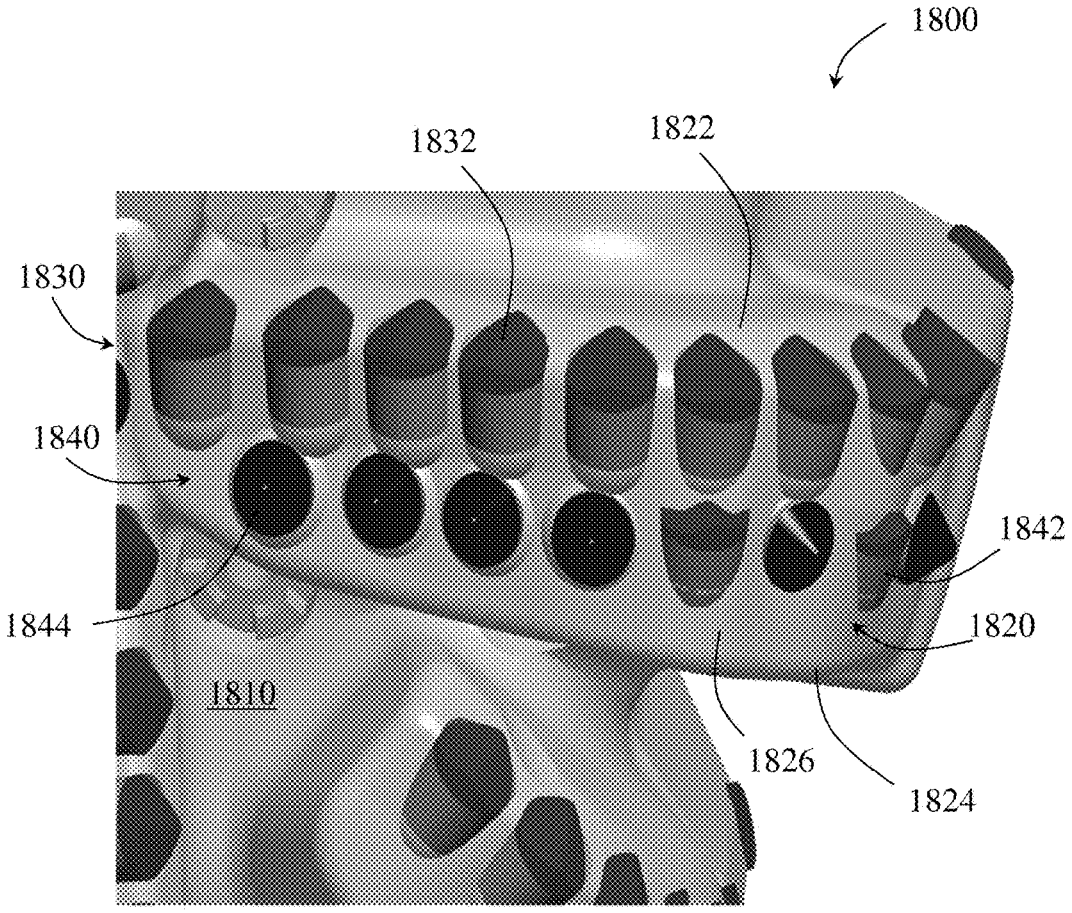
FIG. 18 shows a partial top view of a drill bit according to one embodiment.

FIG. 18 shows a partial view of a drill bit according to embodiments of the present disclosure. The drill bit 1800 has a bit body 1810 and at least one blade 1820 extending from the bit body 1810. Each blade 1820 has a cutting face 1822 that faces in the direction of bit rotation, a trailing face 1824 opposite the cutting face 1822, and a top face 1826. A first row 1830 of cutting elements is disposed adjacent the cutting face 1822 of at least one blade 1820. One or more of the cutting elements in the first row 1830 may include a cutting element 1832 (that may be any of the above described cutting elements). For example, the cutting element 1832 may include a substrate having an upper surface with a crest formed therein, the crest transitioning into a depressed region, and an ultrahard layer on the upper surface, thereby forming a non-planar interface between the ultrahard layer and the substrate. In another embodiment, a top surface of the ultrahard layer has at least one cutting crest extending along a diameter from a cutting edge portion of an undulating peripheral edge. In the embodiment shown, the cutting crest along the top surface of the cutting element 1832 forms a substantially parabolic cylinder shape. Further, in one or more embodiments, any of the top surface geometries may be used in combination with any of the substrate/interface surface geometries.

The bit 1800 further includes a second row 1840 of cutting elements disposed along the top face 1826 of the blade 1820, rearward of the first row 1830. In other words, the first row 1830 of cutting elements is disposed along the blade 1820 at the cutting face 1822, while the second row 1840 of cutting elements is disposed along the top face 1826 of the blade 1820 in a position that is distal from the cutting face 1822. One or more of the cutting elements in the second row 1840 may include a cutting element 1842 according to embodiments of the present disclosure. For example, as shown, the cutting element 1842 may have a non-planar top surface and a non-planar interface (not shown) formed between an ultrahard layer and a substrate of the cutting element, such as described above. A cutting element in either the first row 1830 or the second row 1840 or in both the first row 1830 and the second row 1840 may be a ridge cutting element (e.g., a cutting element having a parabolic cylinder or a hyperbolic paraboloid shape). Further, other cutting elements having planar or non-planar top surfaces may be in a first row and/or second row on a blade. For example, as shown in FIG. 18, the second row 1840 of cutting elements may also include pointed cutting elements 1844. Pointed cutting elements 1844 may be positioned on the blade 1820 such that the central or longitudinal axis of the cutting element 1844 is at an angle with the top surface 1826 of the blade 1820, where the angle may range from, for example, greater than 0 degrees to 90 degrees. Likewise, other cutting elements having planar or non-planar top surfaces may have a central or longitudinal axis at an angle with the top surface of the blade ranging from greater than 0 degrees to 90 degrees. As shown in FIG. 18, ridge cutting elements 1832, 1842 according to embodiments of the present disclosure may be positioned on the blade 1820 at an angle (formed between a line parallel to the bit axis and a line extending through the radial ends of the cutting crest) ranging from greater than 0 degrees to 40 degrees (or at least 5, 10, 15, 20, 25, 30, or 35 degrees in various other embodiments). In one or more other embodiments, pointed cutting elements 1844 may be positioned on the blade 1820 at an angle (formed between a line parallel to the bit axis and a central axis of the cutting element) ranging from 0 degrees to 20 degrees, where the tip of the cutting element rotationally leads its substrate, i.e., points in the direction of the leading face.

Further, in the embodiment shown in FIG. 18, cutting elements in the second row 1840 may be positioned rearward of cutting elements in the first row 1830 such that one or more cutting element in the second row 1840 shares a radial position with one or more cutting element in the first row. Cutting elements sharing the same radial position on a blade are positioned at the same radial distance from the central or longitudinal axis of the bit, such that as the bit rotates, the cutting elements cut along the same radial path. A cutting element in the second row 1840 and a cutting element in the first row 1830 sharing a same radial position may be referred to as a backup cutting element and a primary cutting element, respectively. In other words, as used herein, the term "backup cutting element" is used to describe a cutting element that trails any other cutting element on the same blade when the bit is rotated in the cutting direction, and the term "primary cutting element" is used to describe a cutting element provided on the leading edge of a blade. Thus, when a bit is rotated about its central axis in the cutting direction, a "primary cutting element" does not trail any other cutting elements on the same blade. Other cutting elements in the second row 1840 may partially overlap the radial position of cutting elements in the first row 1830 or may be positioned in a radially adjacent position to cutting elements in the first row (i.e., where a cutting element in the second row is positioned rearward of a cutting element in the first row and do not share a radial position along the bit blade). Further, while the illustrated embodiment shows the first row 1830 being filled entirely with ridge cutting elements 1842, it is also intended that fewer than all of the cutting elements on the first row 1830 have such geometry and may include pointed cutting elements or planar cutting elements. Such mixing of cutting element types may also be intended for the second row, or the second row may include cutting elements of the same type.

Figure 19:
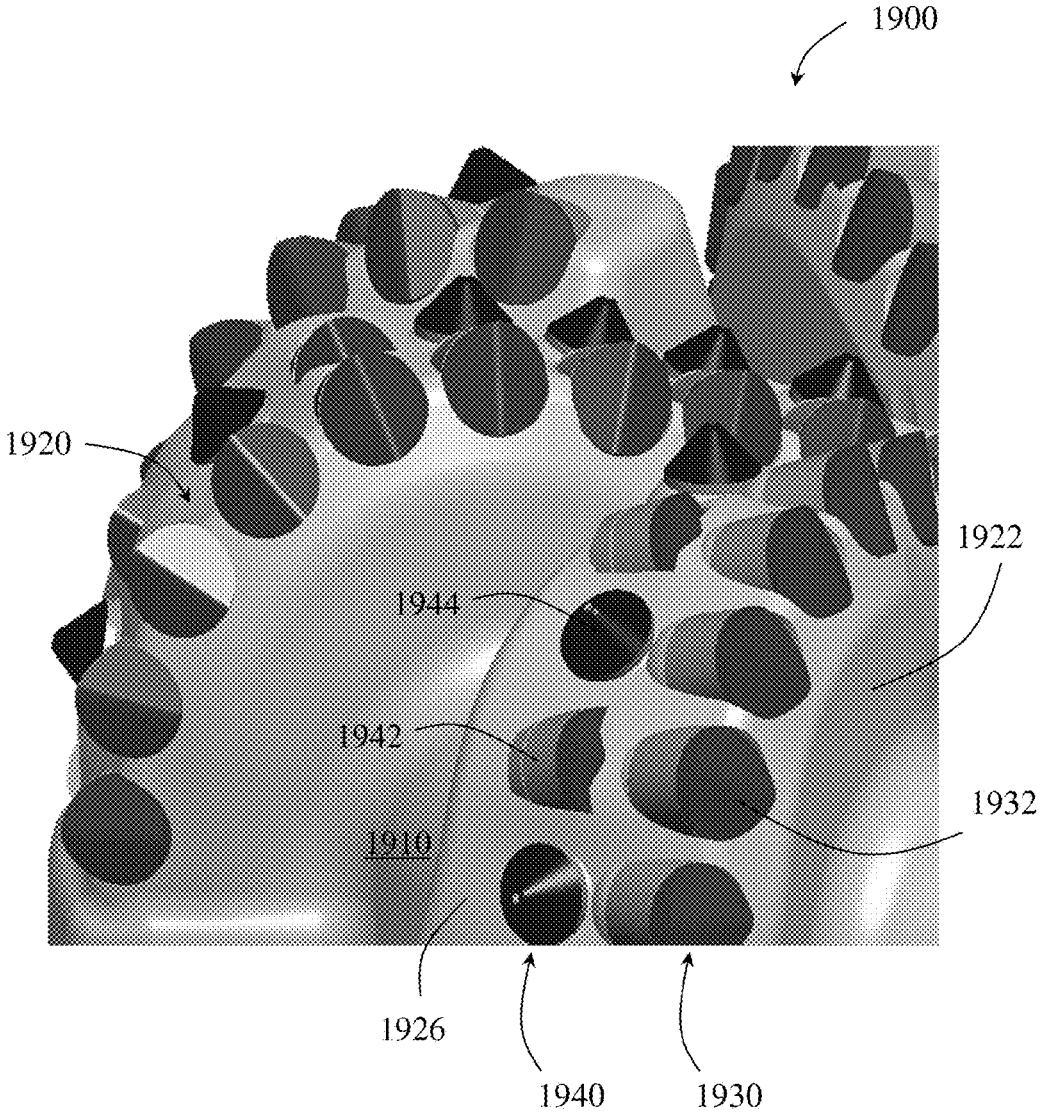
FIG. 19 shows a partial side view of a drill bit according to one embodiment.

FIG. 19 shows a partial view of a drill bit according to embodiments of the present disclosure. The drill bit 1900 has a bit body 1910 and at least one blade 1920 extending from the bit body 1910. Each blade 1920 has a cutting face 1922 that faces in the direction of bit rotation, a trailing face opposite the cutting face 1922, and a top face 1926. A first row 1930 of cutting elements is disposed along the cutting face 1922 of at least one blade 1920. One or more of the cutting elements in the first row 1930 may include a ridge cutting element 1932. For example, the cutting element 1932 may include a substrate having an upper surface with a crest formed therein, where the crest transitions into a depressed region, and an ultrahard layer on the upper surface, thereby forming a non-planar interface between the ultrahard layer and the substrate. Further, a top surface of the ultrahard layer has a cutting crest extending across a diameter of the cutting element and decreases in height extending laterally away from the cutting crest. In the embodiment shown, the cutting crest along the top surface of the cutting element 1932 forms a parabolic cylinder shape.

The bit 1900 further includes a second row 1940 of cutting elements disposed along the top face 1926 of the blade 1920, rearward of the first row 1930. Cutting elements in the second row 1940 include at least one ridge cutting element 1942 and at least one pointed cutting element 1944. Pointed cutting elements 1944 may be positioned in an alternating arrangement with ridge cutting elements 1942 along the second row 1940. In other embodiments, a single type of cutting element (e.g., a ridge cutting element, a pointed cutting element, or a cutting element having a planar top surface) may be positioned adjacent to each other within a row of cutting elements. For example, as shown in FIG. 18, a portion of the second row 1840 includes a plurality of pointed cutting elements 1844 positioned adjacent to each other, and another portion of the second row 1840 includes pointed cutting elements 1844 in an alternating arrangement with the ridge cutting elements 1842. Further, the entire first row 1830 of cutting elements may include a plurality of ridge cutting elements 1832.

Figure 20:
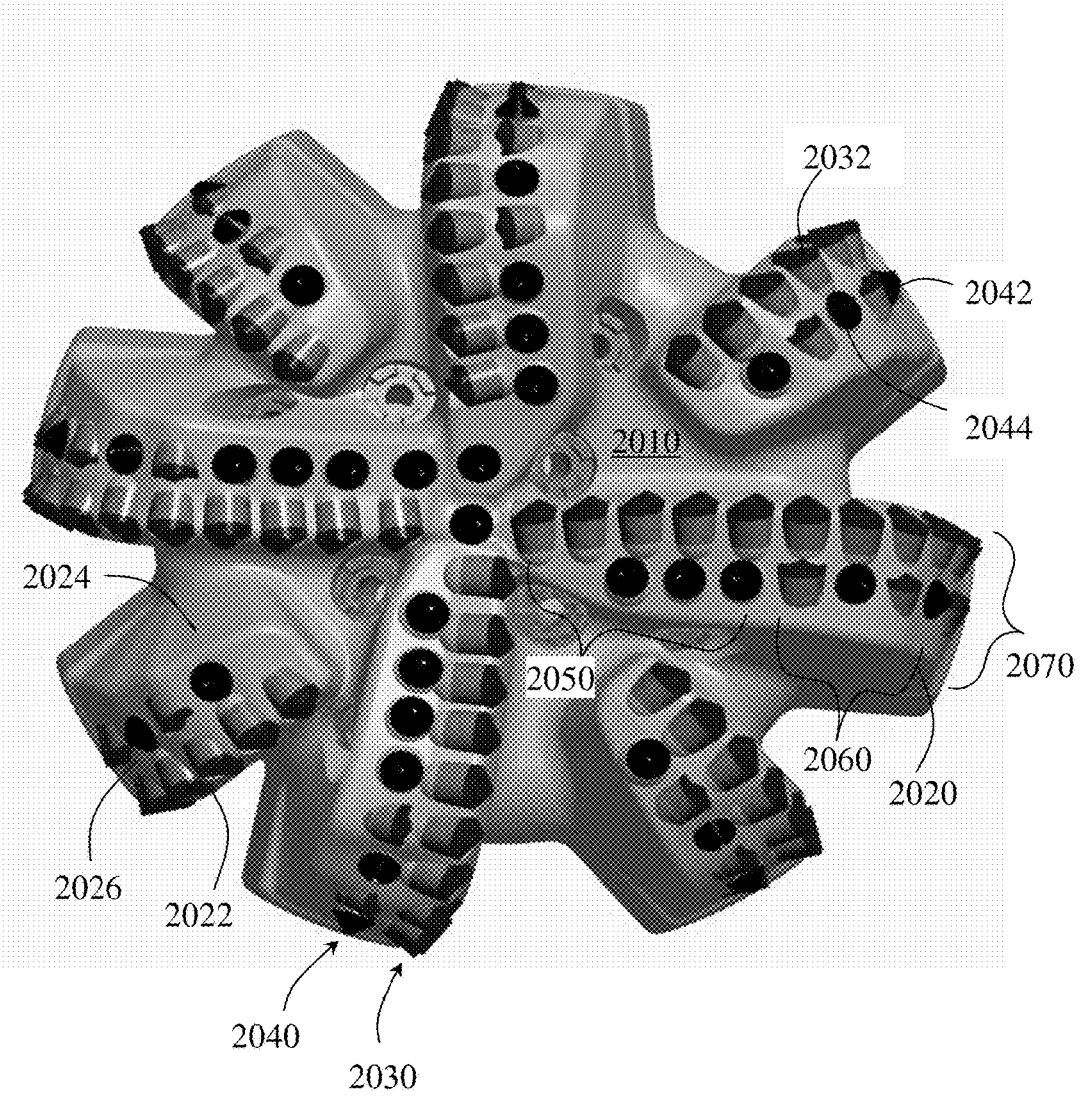
FIG. 20 shows a top view of a drill bit according to one embodiment.
Figure 21:
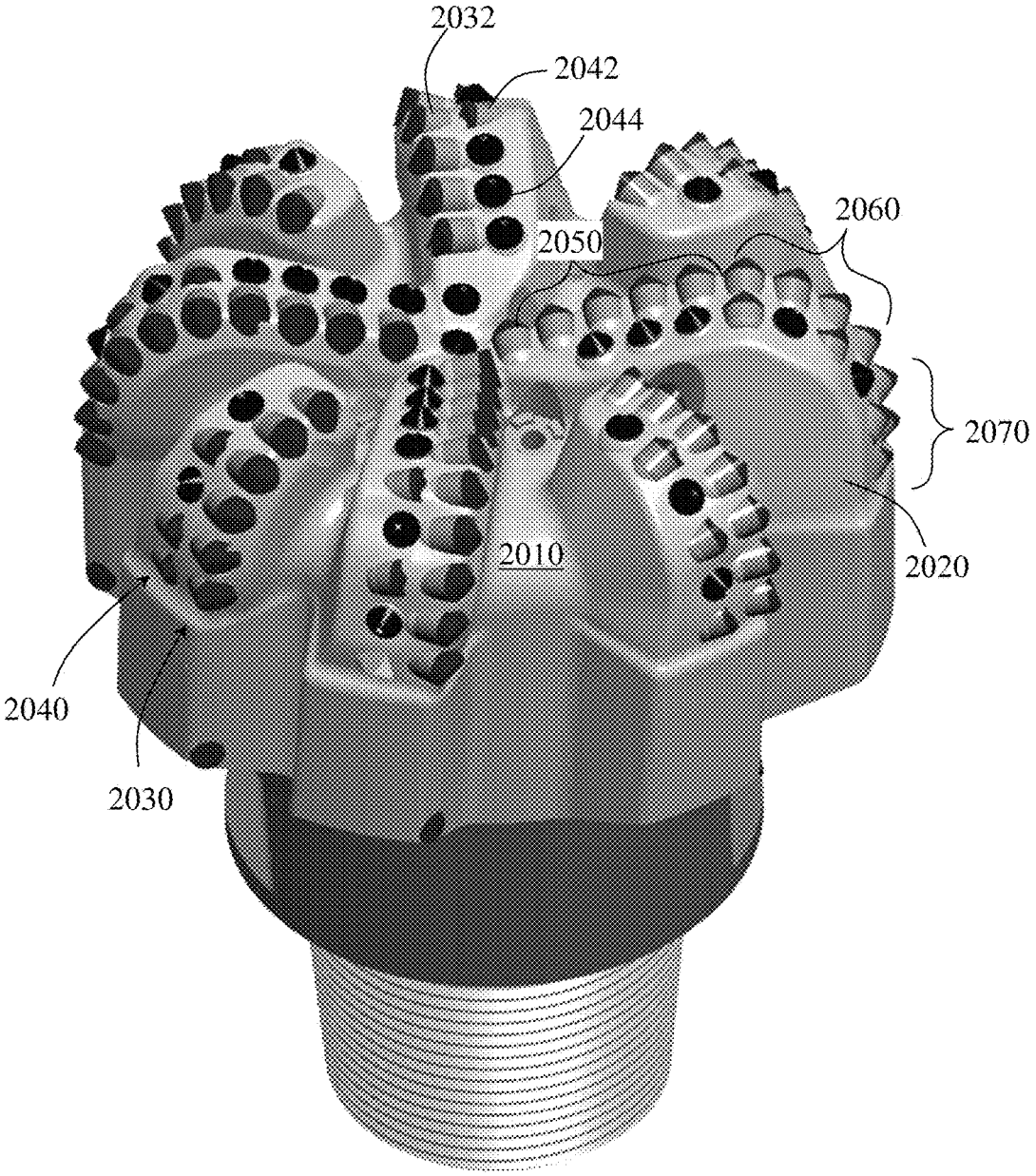
FIG. 21 shows a perspective view of the drill bit of FIG. 20.

For example, FIGS. 20 and 21 show a bottom view and a side view of a drill bit 2000 according to embodiments of the present disclosure having a bit body 2010 and a plurality of blades 2020 extending therefrom. Each blade 2020 has a leading face 2022, a trailing face 2024 opposite the leading face, and a top face 2026. A first row 2030 of cutting elements is disposed along the leading edge (where the leading face transitions to the top face) of at least one blade, where the cutting elements 2032 in the first row are ridge cutting elements. A second row 2040 of cutting elements is disposed along the top face of the blade and rearward of the first row 2030 of cutting elements, where the second row 2040 includes ridge cutting elements 2042 and pointed cutting elements 2044. The second row 2040 of cutting elements along a cone region 2050 of the blade 2020 includes pointed cutting elements 2044, and the second row 2040 of cutting elements along a shoulder region 2060 of the blade 2020 includes an alternating arrangement of pointed cutting elements 2044 and ridge cutting elements 2042. Further, the second row 2040 of cutting elements along a gage region 2070 of the blade 2020 includes one or more ridge cutting elements 2042. However, in other embodiments, different combinations of types of cutting elements may be positioned in a row along a cone region, a shoulder region and a gage region of a blade as described above. In addition, different combinations of types of cutting elements may be positioned in a row along a cone region, a shoulder region and a gage region of each of the first and second rows of cutting elements (e.g., different primary and secondary cutting elements in each of the above described regions may be used).

As mentioned above, the apex of the non-planar cutting element (both the pointed cutting elements and the ridge cutting elements) may have curvature, including a radius of curvature. In one or more embodiments, the radius of curvature may range from about 0.050 to 0.125. One or more other embodiments may use a radius of curvature of with a lower limit of any of 0.050, 0.060, 0.075, 0.085, or 0.100 and an upper limit of any of 0.075, 0.085, 0.095, 0.100, 0.110, or 0.0125, where any lower limit can be used with any upper limit. In some embodiments, the curvature may have a variable radius of curvature, a portion of a parabola, a portion of a hyperbola, a portion of a catenary, or a parametric spline. Further, in one or more embodiments, the different apex curvatures may be used in (the same geometry-type or different geometry type) cutting elements along a cutting profile. This may include, for example, the various embodiments described above, as well as embodiments including all conical cutting elements, or all bullet cutting elements, or all parabolic cylinder cutting elements etc., along a cutting profile. Specifically a "blunt" cutting element may include any type of non-planar cutting element having a larger radius of curvature as compared to another, "sharp" non-planar cutting element on the same bit. Thus, the terms blunt and sharp are relative to one another, and the radius of curvatures of each may selected from any point along the radius range discussed above.

For example, in one embodiment, the cone region may include one or more (or all) blunt cutting elements and the nose, shoulder, and gage regions may include one or more (or all) sharp cutting elements. Such embodiment may be selected, for example, when greater impact protection in the cone region is desired.

In another embodiment, the cone and nose regions may include one or more (or all) blunt cutting elements and the shoulder and gage regions may include one or more (or all) sharp cutting elements. Such embodiment may be selected, for example, when greater impact protection in the cone and nose region is desired.

In another embodiment, the cone, nose, and shoulder regions may include one or more (or all) blunt cutting elements and the gage region may include one or more (or all) sharp cutting elements. Such embodiment may be selected, for example, when greater impact protection in the cone, nose, and shoulder region is desired.

In one embodiment, the cone region may include one or more (or all) sharp cutting elements and the nose, shoulder, and gage regions may include one or more (or all) blunt cutting elements. Such embodiment may be selected, for example, when greater impact protection in the nose, shoulder, and gage region is desired.

In another embodiment, the cone and nose regions may include one or more (or all) sharp cutting elements and the shoulder and gage regions may include one or more (or all) blunt cutting elements. Such embodiment may be selected, for example, when greater impact protection in the shoulder and gage region is desired.

In another embodiment, the cone, nose, and shoulder regions may include one or more (or all) sharp cutting elements and the gage region may include one or more (or all) blunt cutting elements. Such embodiment may be selected, for example, when greater impact protection in the gage region is desired.

Further, in another embodiment, the cone and shoulder region may have the same selected bluntness or sharpness, with a different radius in the nose region. For example, in one embodiment, the cone and shoulder regions may include one or more (or all) sharp cutting elements and the nose region may include one or more (or all) blunt cutting elements. It is also within the scope of the present disclosure that the gage region may also have one or more (or all) blunt cutting elements.

In another embodiment, the cone and shoulder region may include one or more (or all) blunt cutting elements and the nose region may include one or more (or all) sharp cutting elements. It is also within the scope of the present disclosure that the gage region may also have one or more (or all) sharp cutting elements.

Further, in one or more other embodiments, the diameter of the non-planar cutting element may be varied along the cutting profile. For example, the diameter of the non-planar cutting elements may generally range from 9 mm to 20 mm, such as 9 mm, 11 mm, 13 mm, 16 mm, 19 mm, and 22 mm. Selection of different sizes along the cutter profile may allow variation in the number of cutting elements at a particular region of the blades. Specifically a "large" cutting element may include any type of non-planar cutting element having a larger diameter as compared to another, "small" non-planar cutting element on the same bit. Thus, the terms large and small are relative to one another, and the diameter of each may selected from any point along the diameter range discussed above. Further, it is also within the scope of the present disclosure that the same diameter cutting element may be used in any of the above described embodiments, and the desired size may be selected, for example, based on the type of formation to be drilled. For example, in softer formations, it may be desirable to use a larger cutting element, whereas in a harder formation, it may be desirable to use a smaller cutting element.

For example, in one embodiment, the cone region may include one or more (or all) small cutting elements and the nose, shoulder, and gage regions may include one or more (or all) large cutting elements. Such embodiment may be selected, for example, when greater diamond density and impact load distribution in the cone region is desired.

In another embodiment, the cone and nose regions may include one or more (or all) small cutting elements and the shoulder and gage regions may include one or more (or all) large cutting elements. Such embodiment may be selected, for example, when greater diamond density and impact load distribution in the cone and nose region is desired.

In another embodiment, the cone, nose, and shoulder regions may include one or more (or all) small cutting elements and the gage region may include one or more (or all) large cutting elements. Such embodiment may be selected, for example, when greater diamond density and impact load distribution in the cone, nose, and shoulder region is desired.

In one embodiment, the cone region may include one or more (or all) large cutting elements and the nose, shoulder, and gage regions may include one or more (or all) small cutting elements. Such embodiment may be selected, for example, when greater impact protection in the nose, shoulder, and gage region is desired.

In another embodiment, the cone and nose regions may include one or more (or all) large cutting elements and the shoulder and gage regions may include one or more (or all) small cutting elements. Such embodiment may be selected, for example, when greater diamond density and impact load distribution in the shoulder and gage region is desired.

In another embodiment, the cone, nose, and shoulder regions may include one or more (or all) large cutting elements and the gage region may include one or more (or all) small cutting elements. Such embodiment may be selected, for example, when greater diamond density and impact load distribution in the gage region is desired.

Further, in another embodiment, the cone and shoulder region may have the same selected diameter, with a different size in the nose region. For example, in one embodiment, the cone and shoulder regions may include one or more (or all) large cutting elements and the nose region may include one or more (or all) small cutting elements. It is also within the scope of the present disclosure that the gage region may also have one or more (or all) small cutting elements.

In another embodiment, the cone and shoulder region may include one or more (or all) small cutting elements and the nose region may include one or more (or all) large cutting elements. It is also within the scope of the present disclosure that the gage region may also have one or more (or all) large cutting elements.

Further, it is also specifically within the scope of the present disclosure that various combinations of the different shapes, radii, and diameters may be used together along a cutting profile. For example, in one or more particular embodiments, the cutting elements may include both the different cutting end shapes as well as different diameters along the cutting profile. That is, a cutting element in the cone region may have a first shape and first diameter, a cutting element in the nose region may have a second shape and the first (or a second) diameter, a cutting element in the shoulder region may have the second shape and the first (or the second) diameter, and a cutting element in a gage may have the second shape and the second diameter. Additionally, a cutting element in the cone region may have a first shape and first diameter, a cutting element in the nose region may have a first shape and the first (or a second) diameter, a cutting element in the shoulder region may have the second shape and the first (or the second diameter, and a cutting element in a gage may have the second shape and the second diameter. Finally, a cutting element in the cone region may have a first shape and first diameter, a cutting element in the nose region may have the first shape and the first (or a second) diameter, a cutting element in the shoulder region may have the first shape and the first (or the second) diameter, and a cutting element in a gage may have the second shape and the second diameter. Other combinations may also be envisioned in view of the above disclosure.

Further, as mentioned above, it is also within the scope of the present disclosure that one or more planar cutting elements, i.e., shear cutters, may be used at any location along the cutting profile in the primary and/or backup cutter positions. Thus, variations on the above embodiments also exist in which one or more of the regions may include one or more (or all) shear cutters. For example, in one embodiment, it is envisioned the shear cutters may particularly be used, for example, along the gage region. However, other embodiments replacing cutting elements along other regions may also be envisioned. In addition, in some embodiments, one or more of the non-planar cutting elements and/or the planar cutting elements may be rotating or rolling cutting elements (i.e., planar cutting elements that are rotatable about their longitudinal axis). Such rolling cutting elements could be used in one or more of the regions. For example, in some embodiments, one or more rolling cutter elements is used as a primary cutting element in a high wear region such as the shoulder region or any other high wear region.

The non-planar cutting elements provided on a drill bit or reamer (or other cutting tool of the present disclosure) include a diamond layer on a substrate (such as a cemented tungsten carbide substrate), where the diamond layer forms the non-planar diamond working surface. Non-planar cutting elements may be formed in a process similar to that used in forming diamond enhanced inserts (used in roller cone bits) or may be formed by brazing the components together or may be formed by any suitable method. The interface between diamond layer and substrate may be non-planar or non-uniform, for example, to aid in reducing incidents of delamination of the diamond layer from substrate when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip or ridge region of the layer. Further, it may be desirable to create the interface geometry such that the diamond layer is thickest at a zone that encompasses a contact zone between the diamond enhanced element and the formation (e.g., a primary contact zone or a critical zone). Additional shapes and interfaces that may be used for the diamond enhanced elements of the present disclosure include those described in U.S. Patent Publication No. 2008/0035380, which is herein incorporated by reference in its entirety.

In one or more embodiments, the diamond layer of pointed cutting elements may have a thickness of 0.100 to 0.500 inches from the apex to the thickest region of the substrate, and in or more embodiments, such thickness may range from 0.125 to 0.275 inches. The diamond layer and the cemented metal carbide substrate of pointed cutting elements may have a total thickness of 0.200 to 0.700 inches from the apex to a base of the cemented metal carbide substrate. However, other sizes and thicknesses may also be used.

Further, the diamond layer may be formed from any polycrystalline superabrasive material, including, for example, polycrystalline diamond, polycrystalline cubic boron nitride, thermally stable polycrystalline diamond (formed either by treatment of polycrystalline diamond formed from a metal such as cobalt or polycrystalline diamond formed with a metal having a lower coefficient of thermal expansion than cobalt). Further, in one or more embodiments, the diamond grade (i.e., diamond powder composition including grain size and/or metal content) may be varied within a diamond layer. For example, in one or more embodiments, the region of diamond layer adjacent the substrate may differ in material properties (and diamond grade) as compared the region of diamond layer at the apex of the cutting element. Such variation may be formed by a plurality of step-wise layers or by a gradual transition.

Thus, in one or more embodiments, the more wear resistant diamond layers may be formed from ultrahard materials (such as diamond) having varying levels of thermal stability. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Such ultrahard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultrahard material such as a cubic boron nitride.

As known in the art, thermally stable diamond may be formed in various manners. For example, acids may be used to "leach" the cobalt from a polycrystalline diamond lattice structure (either a thin volume of the polycrystalline diamond or substantially the entire polycrystalline diamond) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc. By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

In some embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. Polycrystalline diamond compact cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer, such as by increasing the pressure to above 50 kbar with a temperature of above 1350° C.

Figure 9:
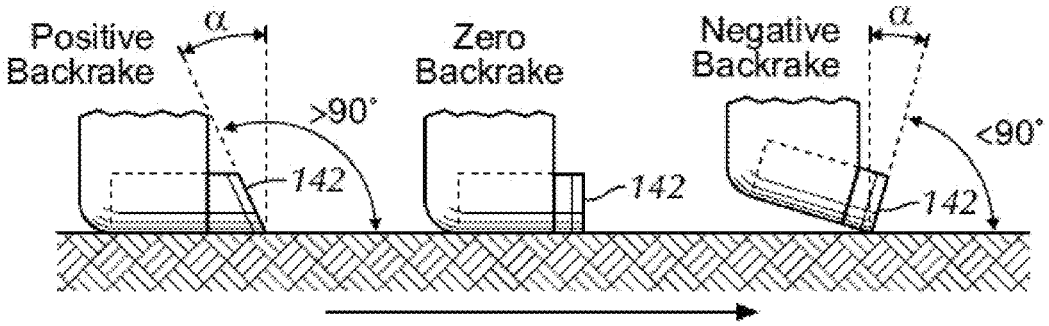
FIG. 9 shows cutters according to one or more embodiments.

The cutting elements of the present disclosure may be oriented at any back rake or side rake. Generally, when positioning cutting elements (specifically cutters) on a blade of a bit or reamer, the cutters may be inserted into cutter pockets (or holes in the case of conical cutting elements) to change the angle at which the cutter strikes the formation. Specifically, the back rake (i.e., a vertical orientation) and the side rake (i.e., a lateral orientation) of a cutter may be adjusted. Generally, back rake is defined as the angle $\alpha$ formed between the cutting face of the cutter 142 and a line that is normal to the formation material being cut. As shown in FIG. 9, with a conventional cutter 142 having zero back rake, the cutting face is substantially perpendicular or normal to the formation material. A cutter 142 having negative back rake angle α has a cutting face that engages the formation material at an angle that is less than 90° as measured from the formation material. Similarly, a cutter 142 having a positive back rake angle α has a cutting face that engages the formation material at an angle that is greater than 90° when measured from the formation material. Side rake is defined as the angle between the cutting face and the radial plane of the bit (x-z plane). When viewed along the z-axis, a negative side rake results from counterclockwise rotation of the cutter, and a positive side rake, from clockwise rotation. In a particular embodiment, the back rake of the conventional cutters may range from −5 to −45, and the side rake from 0-30. The ridge cutting elements may be oriented in the bit such that a circumferential edge of the cutting element adjacent the ridge is configured to engage the formation. The pointed cutting elements may be oriented in the bit such that the apex of the cutting element is configured to engage the formation.

Figure 10:
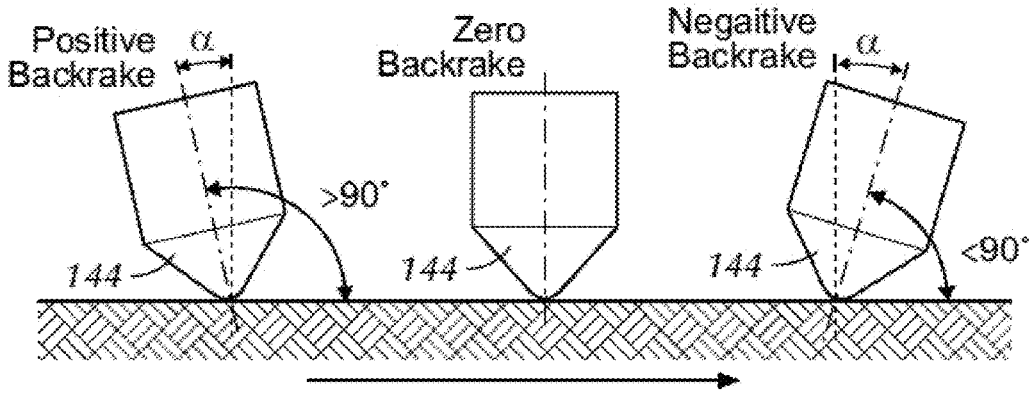
FIG. 10 shows conical cutting elements according to one or more embodiments.

While ridge cutting elements may be described as having a back rake and side rake in a similar manner as planar cutting elements, pointed cutting elements do not have a cutting face and thus the orientation of pointed cutting elements should be defined differently. When considering the orientation of pointed cutting elements, in addition to the vertical or lateral orientation of the cutting element body, the pointed geometry of the cutting end also affects how and the angle at which the pointed cutting element strikes the formation. Specifically, in addition to the back rake affecting the aggressiveness of the non-planar cutting element-formation interaction, the cutting end geometry (specifically, the apex angle and radius of curvature) greatly affect the aggressiveness that a pointed cutting element attacks the formation. In the context of a pointed cutting element, as shown in FIG. 10, back rake is defined as the angle α formed between the axis of the pointed cutting element 144 (specifically, the axis of the pointed cutting end) and a line that is normal to the formation material being cut. As shown in FIG. 10, with a pointed cutting element 144 having zero back rake, the axis of the pointed cutting element 144 is substantially perpendicular or normal to the formation material. A pointed cutting element 144 having negative back rake angle α has an axis that engages the formation material at an angle that is less than 90° as measured from the formation material. Similarly, a pointed cutting element 144 having a positive back rake angle α has an axis that engages the formation material at an angle that is greater than 90° when measured from the formation material. In some embodiments, the back rake angle of the pointed cutting elements may be zero, or in some embodiments may be negative. In some embodiments, the back rake of the pointed cutting elements may range from −10 to 10, from zero to 10, and/or from −5 to 5.

Figure 11:
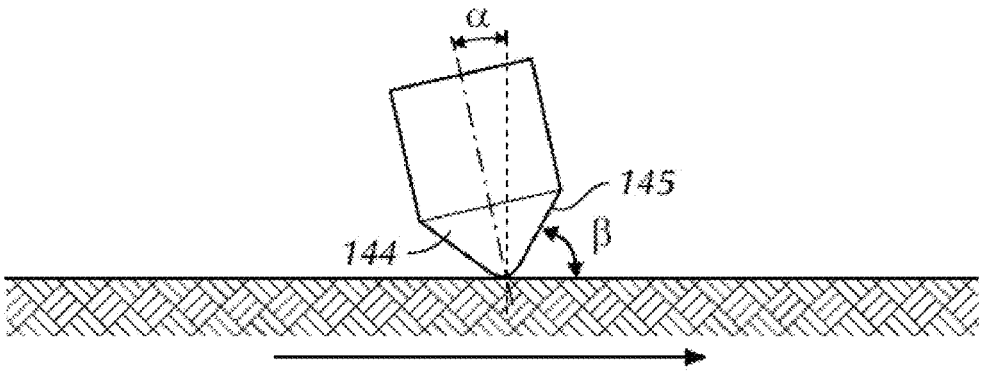
FIG. 11 shows a conical cutting element according to one or more embodiments.

In addition to the orientation of the axis with respect to the formation, the aggressiveness of the pointed cutting elements may also be dependent on the apex angle or specifically, the angle between the formation and the leading portion of the pointed cutting element. Because of the cutting end shape of the pointed cutting elements, there does not exist a leading edge; however, the leading line of a pointed cutting surface may be determined to be the first most points of the pointed cutting element at each axial point along the non-planar cutting end surface as the bit rotates. Said in another way, a cross-section may be taken of a pointed cutting element along a plane in the direction of the rotation of the bit, as shown in FIG. 11. The leading line 145 of the pointed cutting element 144 in such plane may be considered in relation to the formation. The strike angle of a pointed cutting element 144 is defined to be the angle α formed between the leading line 145 of the pointed cutting element 144 and the formation being cut.

Figure 12:
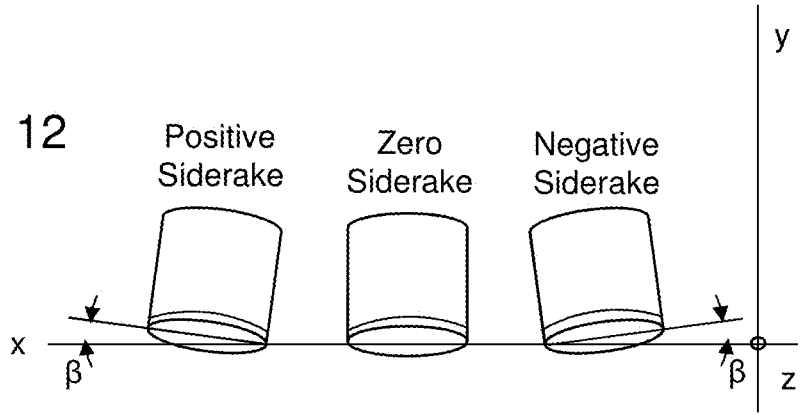
FIG. 12 shows cutters according to one or more embodiments.

Conventionally for polycrystalline diamond compact cutters, side rake is defined as the angle between the cutting face and the radial plane of the bit (x-z plane), as illustrated in FIG. 12. When viewed along the z-axis, a negative side rake angle β results from counterclockwise rotation of the cutter, and a positive side rake angle β, from clockwise rotation. In a particular embodiment, the side rake of cutters may range from −30 to 30, and from 0 to 30 in other embodiments.

Figure 13:
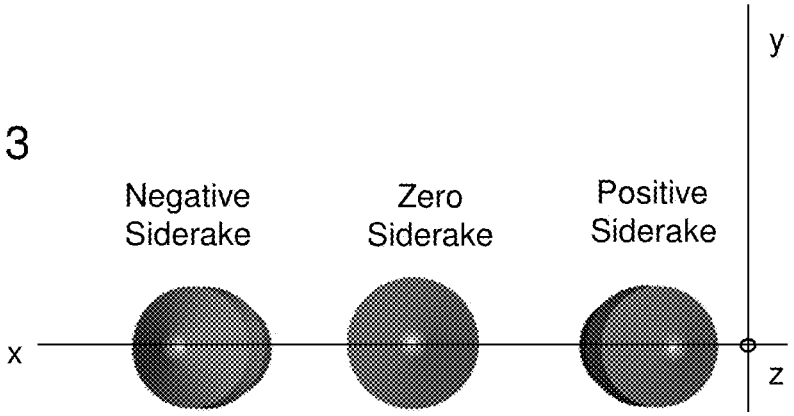
FIG. 13 shows top views of conical cutting elements according to one or more embodiments.
Figure 14:
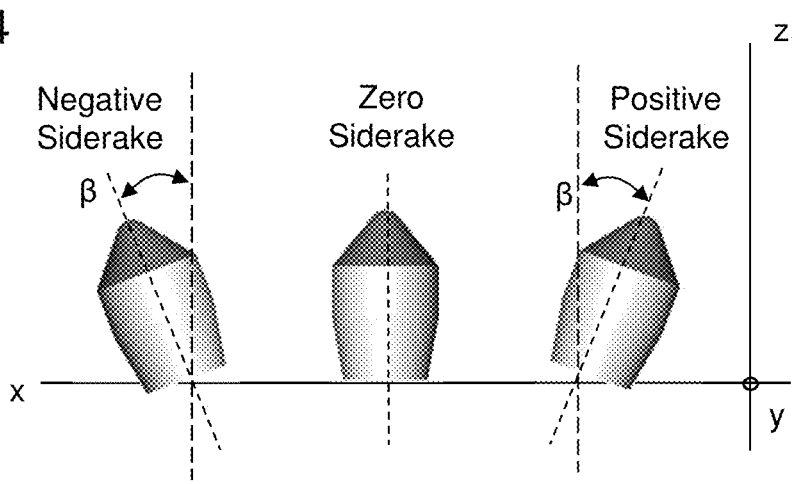
FIG. 14 shows side views of conical cutting elements according to one or more embodiments.

However, pointed cutting elements do not have a cutting face and thus the orientation of pointed cutting elements should be defined differently. In the context of a pointed cutting element, as shown in FIGS. 13 and 14, side rake is defined as the angle β formed between the axis of the pointed cutting element (specifically, the axis of the conical cutting end) and a line parallel to the bit centerline, i.e., z-axis. As shown in FIGS. 13 and 14B, with a pointed cutting element having zero side rake, the axis of the pointed cutting element is substantially parallel to the bit centerline. A pointed cutting element having negative side rake angle β has an axis that is pointed away from the direction of the bit centerline. Conversely, a pointed cutting element having a positive side rake angle β has an axis that points towards the direction of the bit centerline. The side rake of the pointed cutting elements may range from about −30 to 30 in various embodiments and from −10 to 10 in other embodiments. Further, the side rake angles of the pointed cutting elements in embodiments of the present disclosure may be selected from these ranges.

Figure 22:
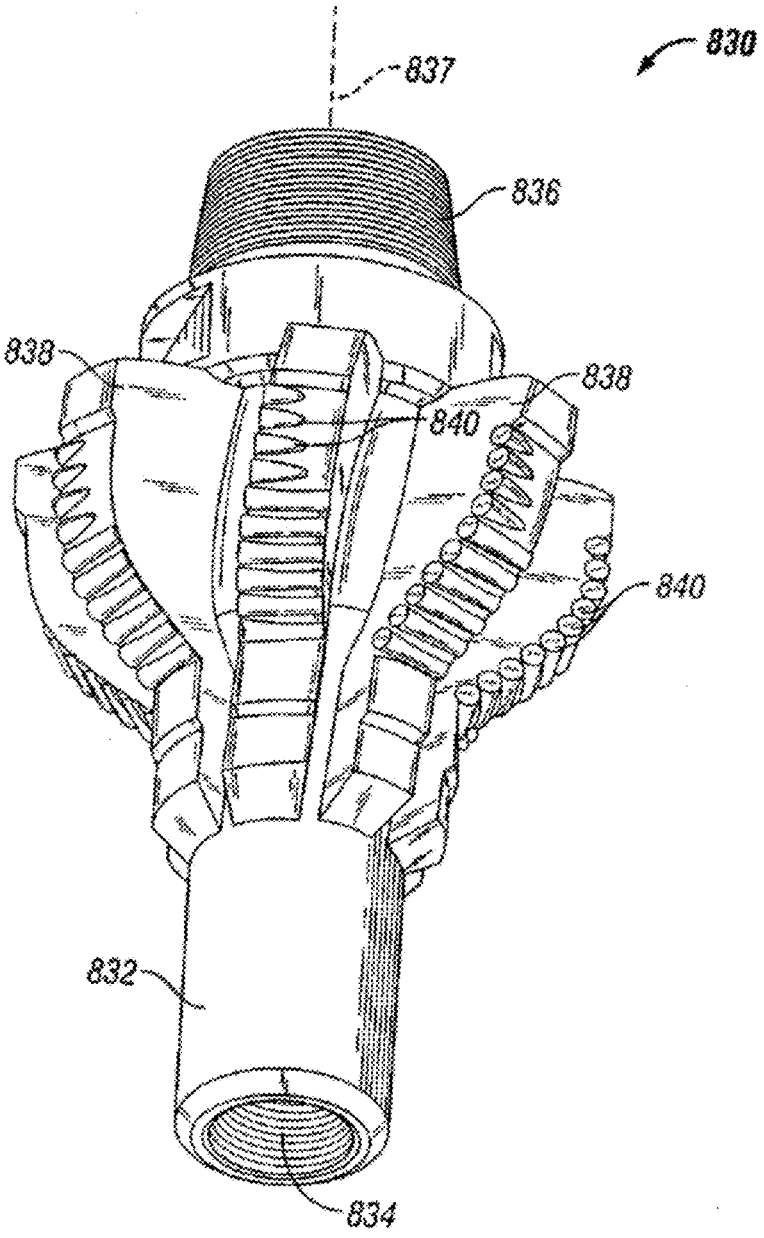
FIG. 22 shows a reamer according to one or more embodiments.

As described throughout the present disclosure, the cutting elements and cutting structure combinations may be used on either a fixed cutter drill bit or hole opener. FIG. 22 shows a general configuration of a hole opener 830 that includes one or more non-planar cutting elements of the present disclosure. The hole opener 830 includes a tool body 832 and a plurality of blades 838 disposed at selected azimuthal locations about a circumference thereof. The hole opener 830 generally includes connections 834, 836 (e.g., threaded connections) so that the hole opener 830 may be coupled to adjacent drilling tools that include, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown).

The blades 838 shown in FIG. 22 are spiral blades and are generally positioned at substantially equal angular intervals about the perimeter of the tool body so that the hole opener 830. This arrangement is not a limitation on the scope of the invention, but rather is used merely to illustrative purposes. Those having ordinary skill in the art will recognize that any downhole cutting tool may be used. While FIG. 22 does not detail the location of the non-planar cutting elements, their placement on the tool may be according to all the variations described above.

Although only a few example embodiments have been described in detail above, those skilled in the art will readily appreciate that many modifications are possible in the embodiments without materially departing from this disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A cutting tool, comprising:

a tool body;

a plurality of blades extending from the tool body; and a plurality of differently shaped, cylindrically-bodied, non-planar cutting elements on each of the plurality of blades, the plurality of differently shaped non-planar cutting elements including cutting elements having a cutting end with a first non-planar shape and cutting elements having a cutting end with a second, different non-planar shape, the cutting elements having the first non-planar shape and the cutting elements having the second non-planar shape being arranged in an alternating manner along at least a portion of at least one of the plurality of blades, such that the cutting elements alternate within a leading, primary row, wherein the cutting elements having the first non-planar shape are pointed cutting elements and the cutting elements having the second non-planar shape are ridge cutting elements.

2. The cutting tool of claim 1, wherein the pointed cutting elements comprise cutting elements selected from the group consisting of a bullet cutting element, a conical cutting element, and combinations thereof.

3. The cutting tool of claim 1, wherein the ridge cutting elements comprise cutting elements selected from the group consisting of a cutting element having a surface with a parabolic cylinder shape, a cutting element having a surface with a hyperbolic paraboloid shape, and combinations thereof.

4. The cutting tool of claim 1, wherein a plurality of backup cutting elements comprises pointed cutting elements.

5. The cutting tool of claim 1, wherein a plurality of backup cutting elements are located in a cone region, a nose region, a shoulder region, and a gage region, and the plurality of backup cutting elements comprise the first shape in at least one of the cone region, nose region, shoulder region, and gage region, and the second, different shape, in at least one other region.

6. The cutting tool of claim 1, wherein a plurality of primary cutting elements are located in a cone region, a nose region, a shoulder region, and a gage region, and the plurality of primary cutting elements comprise the first shape in at least one of the cone region, nose region, shoulder region, and gage region, and the second, different shape, in at least one other region.

7. The cutting tool of claim 1, the ridge cutting elements each including a crest extending from a point on a peripheral edge to at least another point on the peripheral edge of the cutting element surface.

8. The cutting tool of claim 1, further comprising a plurality of ridge cutting elements in a backup position on one or more of the plurality of blades.

* * * * *